US008757517B2

(12) United States Patent
Whitaker et al.

(10) Patent No.: US 8,757,517 B2
(45) Date of Patent: Jun. 24, 2014

(54) SHOWERHEAD WITH FLOW DIRECTING PLATES AND RADIAL MODE CHANGER

(71) Applicant: Water Pik, Inc., Fort Collins, CO (US)

(72) Inventors: Carl T. Whitaker, Berthoud, CO (US); Leland C. Leber, Fort Collins, CO (US); Brian Randall Williams, Fort Collins, CO (US)

(73) Assignee: Water Pik, Inc., Fort Collins, CO (US)

( * ) Notice: Subject to any disclaimer, the term of this patent is extended or adjusted under 35 U.S.C. 154(b) by 0 days.

(21) Appl. No.: 13/735,500

(22) Filed: Jan. 7, 2013

(65) Prior Publication Data

US 2013/0119159 A1 May 16, 2013

Related U.S. Application Data

(63) Continuation of application No. 12/560,041, filed on Sep. 15, 2009, now Pat. No. 8,348,181.

(60) Provisional application No. 61/097,069, filed on Sep. 15, 2008.

(51) Int. Cl.

| | |
|---|---|
| ***B05B 1/18*** | (2006.01) |
| ***B05B 1/16*** | (2006.01) |
| ***B05B 1/14*** | (2006.01) |

(52) U.S. Cl.

USPC ..... 239/447; 239/443; 239/446; 239/449; 239/559; 239/560; 239/581.1

(58) Field of Classification Search

USPC ..... 239/436, 443, 444, 446–449, 548, 556, 239/558–562, 567, 581.1

See application file for complete search history.

(56) References Cited

U.S. PATENT DOCUMENTS

| | | | |
|---|---|---|---|
| 203,094 | A | 4/1878 | Wakeman |
| 204,333 | A | 5/1878 | Josias |

(Continued)

FOREIGN PATENT DOCUMENTS

| | | |
|---|---|---|
| CA | 659510 | 3/1963 |
| CA | 2341041 | 8/1999 |

(Continued)

OTHER PUBLICATIONS

Color Copy, Labeled 1A, Gemlo, available at least as early as Dec. 2, 1998.

(Continued)

*Primary Examiner* — Darren W Gorman
(74) *Attorney, Agent, or Firm* — Dorsey & Whitney LLP

(57) ABSTRACT

A showerhead having a plurality of spray modes including a manifold defining a plurality of mode apertures, a front channel plate, a rear channel plate, and a radial mode changer. The front channel plate includes a plurality of front plate partitions connected to an exterior surface of the manifold. The front plate partitions define at least two channels, each channel of the at least two channels corresponds to one of the plurality of spray modes. The mode apertures in the manifold provide fluid communication between the manifold and the at least two channels. The rear channel plate encloses the at least two channels to form at least two chambers. When the radial mode changer is rotated, one or more of the ports of the radial mode changer is aligned with one or more of the mode apertures, and water flows through the radial mode changer into one of the chambers.

20 Claims, 21 Drawing Sheets

(56) References Cited

U.S. PATENT DOCUMENTS

| | | | |
|---|---|---|---|
| 309,349 | A | 12/1884 | Hart |
| 428,023 | A | 5/1890 | Schoff |
| 432,712 | A | 7/1890 | Taylor |
| 445,250 | A | 1/1891 | Lawless |
| 453,109 | A | 5/1891 | Dreisorner |
| 486,986 | A | 11/1892 | Schinke |
| 566,384 | A | 8/1896 | Engelhart |
| 566,410 | A | 8/1896 | Schinke |
| 570,405 | A | 10/1896 | Jerguson et al. |
| 694,888 | A | 3/1902 | Pfluger |
| 800,802 | A | 10/1905 | Franquist |
| 832,523 | A | 10/1906 | Andersson |
| 835,678 | A | 11/1906 | Hammond |
| 845,540 | A | 2/1907 | Ferguson |
| 854,094 | A | 5/1907 | Klein |
| 926,929 | A | 7/1909 | Dusseau |
| 1,001,842 | A | 8/1911 | Greenfield |
| 1,003,037 | A | 9/1911 | Crowe |
| 1,018,143 | A | 2/1912 | Vissering |
| 1,046,573 | A | 12/1912 | Ellis |
| 1,130,520 | A | 3/1915 | Kenney |
| 1,203,466 | A | 10/1916 | Benson |
| 1,217,254 | A | 2/1917 | Winslow |
| 1,218,895 | A | 3/1917 | Porter |
| 1,255,577 | A | 2/1918 | Berry |
| 1,260,181 | A | 3/1918 | Garnero |
| 1,276,117 | A | 8/1918 | Riebe |
| 1,284,099 | A | 11/1918 | Harris |
| 1,327,428 | A | 1/1920 | Gregory |
| 1,451,800 | A | 4/1923 | Agner |
| 1,459,582 | A | 6/1923 | Dubee |
| 1,469,528 | A | 10/1923 | Owens |
| 1,500,921 | A | 7/1924 | Bramson et al. |
| 1,560,789 | A | 11/1925 | Johnson et al. |
| 1,597,477 | A | 8/1926 | Panhorst |
| 1,633,531 | A | 6/1927 | Keller |
| 1,692,394 | A | 11/1928 | Sundh |
| 1,695,263 | A | 12/1928 | Jacques |
| 1,724,147 | A | 8/1929 | Russell |
| 1,724,161 | A | 8/1929 | Wuesthoff |
| 1,736,160 | A | 11/1929 | Jonsson |
| 1,754,127 | A | 4/1930 | Srulowitz |
| 1,758,115 | A | 5/1930 | Kelly |
| 1,778,658 | A | 10/1930 | Baker |
| 1,821,274 | A | 9/1931 | Plummer |
| 1,849,517 | A | 3/1932 | Fraser |
| 1,890,156 | A | 12/1932 | Konig |
| 1,906,575 | A | 5/1933 | Goeriz |
| 1,934,553 | A | 11/1933 | Mueller et al. |
| 1,946,207 | A | 2/1934 | Haire |
| 2,011,446 | A | 8/1935 | Judell |
| 2,024,930 | A | 12/1935 | Judell |
| 2,033,467 | A | 3/1936 | Groeniger |
| 2,044,445 | A | 6/1936 | Price et al. |
| 2,085,854 | A | 7/1937 | Hathaway et al. |
| 2,096,912 | A | 10/1937 | Morris |
| 2,117,152 | A | 5/1938 | Crosti |
| D113,439 | S | 2/1939 | Reinecke |
| 2,196,783 | A | 4/1940 | Shook |
| 2,197,667 | A | 4/1940 | Shook |
| 2,216,149 | A | 10/1940 | Weiss |
| D126,433 | S | 4/1941 | Enthof |
| 2,251,192 | A | 7/1941 | Krumsiek et al. |
| 2,268,263 | A | 12/1941 | Newell et al. |
| 2,285,831 | A | 6/1942 | Pennypacker |
| 2,342,757 | A | 2/1944 | Roser |
| 2,402,741 | A | 6/1946 | Draviner |
| D147,258 | S | 8/1947 | Becker |
| D152,584 | S | 2/1949 | Becker |
| 2,467,954 | A | 4/1949 | Becker |
| 2,546,348 | A | 3/1951 | Schuman |
| 2,567,642 | A | 9/1951 | Penshaw |
| 2,581,129 | A | 1/1952 | Muldoon |
| D116,073 | S | 3/1952 | Dunkelberger |
| 2,648,762 | A | 8/1953 | Dunkelberger |
| 2,664,271 | A | 12/1953 | Arutunoff |
| 2,671,693 | A | 3/1954 | Hyser et al. |
| 2,679,575 | A | 5/1954 | Haberstump |
| 2,680,358 | A | 6/1954 | Zublin |
| 2,726,120 | A | 12/1955 | Bletcher et al. |
| 2,759,765 | A | 8/1956 | Pawley |
| 2,776,168 | A | 1/1957 | Schweda |
| 2,792,847 | A | 5/1957 | Spencer |
| 2,873,999 | A | 2/1959 | Webb |
| 2,930,505 | A | 3/1960 | Meyer |
| 2,931,672 | A | 4/1960 | Merritt et al. |
| 2,935,265 | A | 5/1960 | Richter |
| 2,949,242 | A | 8/1960 | Blumberg et al. |
| 2,957,587 | A | 10/1960 | Tobin |
| 2,966,311 | A | 12/1960 | Davis |
| D190,295 | S | 5/1961 | Becker |
| 2,992,437 | A | 7/1961 | Nelson et al. |
| 3,007,648 | A | 11/1961 | Fraser |
| D192,935 | S | 5/1962 | Becker |
| 3,032,357 | A | 5/1962 | Shames et al. |
| 3,034,809 | A | 5/1962 | Greenberg |
| 3,037,799 | A | 6/1962 | Mulac |
| 3,081,339 | A | 3/1963 | Green et al. |
| 3,092,333 | A | 6/1963 | Gaiotto |
| 3,098,508 | A | 7/1963 | Gerdes |
| 3,103,723 | A | 9/1963 | Becker |
| 3,104,815 | A | 9/1963 | Schultz |
| 3,104,827 | A | 9/1963 | Aghnides |
| 3,111,277 | A | 11/1963 | Grimsley |
| 3,112,073 | A | 11/1963 | Larson et al. |
| 2,676,806 | A | 4/1964 | Bachman |
| 3,143,857 | A | 8/1964 | Eaton |
| 3,196,463 | A | 7/1965 | Farneth |
| 3,231,200 | A | 1/1966 | Heald |
| 3,236,545 | A | 2/1966 | Parkes et al. |
| 3,239,152 | A | 3/1966 | Bachli et al. |
| 3,266,059 | A | 8/1966 | Stelle |
| 3,272,437 | A | 9/1966 | Coson |
| 3,273,359 | A | 9/1966 | Fregeolle |
| 3,306,634 | A | 2/1967 | Groves et al. |
| 3,323,148 | A | 6/1967 | Burnon |
| 3,329,967 | A | 7/1967 | Martinez et al. |
| 3,341,132 | A | 9/1967 | Parkison |
| 3,342,419 | A | 9/1967 | Weese |
| 3,344,994 | A | 10/1967 | Fife |
| 3,363,842 | A | 1/1968 | Burns |
| 3,383,051 | A | 5/1968 | Fiorentino |
| 3,389,925 | A | 6/1968 | Gottschald |
| 3,393,311 | A | 7/1968 | Dahl |
| 3,393,312 | A | 7/1968 | Dahl |
| 3,404,410 | A | 10/1968 | Sumida |
| 3,492,029 | A | 1/1970 | French et al. |
| 3,516,611 | A | 6/1970 | Piggott |
| 3,546,961 | A | 12/1970 | Marton |
| 3,550,863 | A | 12/1970 | McDermott |
| 3,552,436 | A | 1/1971 | Stewart |
| 3,565,116 | A | 2/1971 | Gabin |
| 3,566,917 | A | 3/1971 | White |
| 3,580,513 | A | 5/1971 | Martin |
| 3,584,822 | A | 6/1971 | Oram |
| 3,596,835 | A | 8/1971 | Smith et al. |
| 3,612,577 | A | 10/1971 | Pope et al. |
| 3,637,143 | A | 1/1972 | Shames et al. |
| 3,641,333 | A | 2/1972 | Gendron |
| 3,647,144 | A | 3/1972 | Parkison et al. |
| 3,663,044 | A | 5/1972 | Contreras et al. |
| 3,669,470 | A | 6/1972 | Deurloo |
| 3,672,648 | A | 6/1972 | Price |
| 3,682,392 | A | 8/1972 | Kint |
| 3,685,745 | A | 8/1972 | Peschcke-koedt |
| D224,834 | S | 9/1972 | Laudell |
| 3,711,029 | A | 1/1973 | Bartlett |
| 3,722,798 | A | 3/1973 | Bletcher et al. |
| 3,722,799 | A | 3/1973 | Rauh |
| 3,731,084 | A | 5/1973 | Trevorrow |
| 3,754,779 | A | 8/1973 | Peress |
| D228,622 | S | 10/1973 | Juhlin |
| 3,762,648 | A | 10/1973 | Deines et al. |
| 3,768,735 | A | 10/1973 | Ward |

(56) References Cited

U.S. PATENT DOCUMENTS

| | | | |
|---|---|---|---|
| 3,786,995 | A | 1/1974 | Manoogian et al. |
| 3,801,019 | A | 4/1974 | Trenary et al. |
| 3,810,580 | A | 5/1974 | Rauh |
| 3,826,454 | A | 7/1974 | Zieger |
| 3,840,734 | A | 10/1974 | Oram |
| 3,845,291 | A | 10/1974 | Portyrata |
| 3,860,271 | A | 1/1975 | Rodgers |
| 3,861,719 | A | 1/1975 | Hand |
| 3,865,310 | A | 2/1975 | Elkins et al. |
| 3,869,151 | A | 3/1975 | Fletcher et al. |
| 3,896,845 | A | 7/1975 | Parker |
| 3,902,671 | A | 9/1975 | Symmons |
| 3,910,277 | A | 10/1975 | Zimmer |
| D237,708 | S | 11/1975 | Grohe |
| 3,929,164 | A | 12/1975 | Richter |
| 3,929,287 | A | 12/1975 | Givler et al. |
| 3,958,756 | A | 5/1976 | Trenary et al. |
| D240,322 | S | 6/1976 | Staub |
| 3,963,179 | A | 6/1976 | Tomaro |
| 3,967,783 | A | 7/1976 | Halsted et al. |
| 3,979,096 | A | 9/1976 | Zieger |
| 3,997,116 | A | 12/1976 | Moen |
| 3,998,390 | A | 12/1976 | Peterson et al. |
| 3,999,714 | A | 12/1976 | Lang |
| 4,005,880 | A | 2/1977 | Anderson et al. |
| 4,006,920 | A | 2/1977 | Sadler et al. |
| 4,023,782 | A | 5/1977 | Eifer |
| 4,042,984 | A | 8/1977 | Butler |
| 4,045,054 | A | 8/1977 | Arnold |
| D245,858 | S | 9/1977 | Grube |
| D245,860 | S | 9/1977 | Grube |
| 4,068,801 | A | 1/1978 | Leutheuser |
| 4,081,135 | A | 3/1978 | Tomaro |
| 4,084,271 | A | 4/1978 | Ginsberg |
| 4,091,998 | A | 5/1978 | Peterson |
| D249,356 | S | 9/1978 | Nagy |
| 4,117,979 | A | 10/1978 | Lagarelli et al. |
| 4,129,257 | A | 12/1978 | Eggert |
| 4,130,120 | A | 12/1978 | Kohler, Jr. |
| 4,131,233 | A | 12/1978 | Koenig |
| 4,133,486 | A | 1/1979 | Fanella |
| 4,135,549 | A | 1/1979 | Baker |
| D251,045 | S | 2/1979 | Grube |
| 4,141,502 | A | 2/1979 | Grohe |
| 4,151,955 | A | 5/1979 | Stouffer |
| 4,151,957 | A | 5/1979 | Gecewicz et al. |
| 4,162,801 | A | 7/1979 | Kresky et al. |
| 4,165,837 | A | 8/1979 | Rundzaitis |
| 4,167,196 | A | 9/1979 | Morris |
| 4,174,822 | A | 11/1979 | Larsson |
| 4,185,781 | A | 1/1980 | O'Brien |
| 4,190,207 | A | 2/1980 | Fienhold et al. |
| 4,191,332 | A | 3/1980 | De Langis et al. |
| 4,203,550 | A | 5/1980 | On |
| 4,209,132 | A | 6/1980 | Kwan |
| D255,626 | S | 7/1980 | Grube |
| 4,219,160 | A | 8/1980 | Allred, Jr. |
| 4,221,338 | A | 9/1980 | Shames et al. |
| 4,239,409 | A | 12/1980 | Osrwo |
| 4,243,253 | A | 1/1981 | Rogers, Jr. |
| 4,244,526 | A | 1/1981 | Arth |
| D258,677 | S | 3/1981 | Larsson |
| 4,254,914 | A | 3/1981 | Shames et al. |
| 4,258,414 | A | 3/1981 | Sokol |
| 4,272,022 | A | 6/1981 | Evans |
| 4,274,400 | A | 6/1981 | Baus |
| 4,282,612 | A | 8/1981 | King |
| D261,300 | S | 10/1981 | Klose |
| D261,417 | S | 10/1981 | Klose |
| 4,303,201 | A | 12/1981 | Elkins et al. |
| 4,319,608 | A | 3/1982 | Raikov et al. |
| 4,330,089 | A | 5/1982 | Finkbeiner |
| D266,212 | S | 9/1982 | Haug et al. |
| 4,350,298 | A | 9/1982 | Tada |
| 4,353,508 | A | 10/1982 | Butterfield et al. |
| 4,358,056 | A | 11/1982 | Greenhut et al. |
| D267,582 | S | 1/1983 | Mackay et al. |
| D268,359 | S | 3/1983 | Klose |
| D268,442 | S | 3/1983 | Darmon |
| D268,611 | S | 4/1983 | Klose |
| 4,383,554 | A | 5/1983 | Merriman |
| 4,396,797 | A | 8/1983 | Sakuragi et al. |
| 4,398,669 | A | 8/1983 | Fienhold |
| 4,425,965 | A | 1/1984 | Bayh, III et al. |
| 4,432,392 | A | 2/1984 | Paley |
| D274,457 | S | 6/1984 | Haug |
| 4,461,052 | A | 7/1984 | Mostul |
| 4,465,308 | A | 8/1984 | Martini |
| 4,467,964 | A | 8/1984 | Kaeser |
| 4,495,550 | A | 1/1985 | Visciano |
| 4,527,745 | A | 7/1985 | Butterfield et al. |
| 4,540,202 | A | 9/1985 | Amphoux et al. |
| 4,545,081 | A | 10/1985 | Nestor et al. |
| 4,553,775 | A | 11/1985 | Halling |
| D281,820 | S | 12/1985 | Oba et al. |
| 4,561,593 | A | 12/1985 | Cammack et al. |
| 4,564,889 | A | 1/1986 | Bolson |
| 4,571,003 | A | 2/1986 | Roling et al. |
| 4,572,232 | A | 2/1986 | Gruber |
| D283,645 | S | 4/1986 | Tanaka |
| 4,587,991 | A | 5/1986 | Chorkey |
| 4,588,130 | A | 5/1986 | Trenary et al. |
| 4,598,866 | A | 7/1986 | Cammack et al. |
| 4,614,303 | A | 9/1986 | Moseley, Jr. et al. |
| 4,616,298 | A | 10/1986 | Bolson |
| 4,618,100 | A | 10/1986 | White et al. |
| 4,629,124 | A | 12/1986 | Gruber |
| 4,629,125 | A | 12/1986 | Liu |
| 4,643,463 | A | 2/1987 | Halling et al. |
| 4,645,244 | A | 2/1987 | Curtis |
| RE32,386 | E | 3/1987 | Hunter |
| 4,650,120 | A | 3/1987 | Kress |
| 4,650,470 | A | 3/1987 | Epstein |
| 4,652,025 | A | 3/1987 | Conroy, Sr. |
| 4,654,900 | A | 4/1987 | McGhee |
| 4,657,185 | A | 4/1987 | Rundzaitis |
| 4,669,666 | A | 6/1987 | Finkbeiner |
| 4,669,757 | A | 6/1987 | Bartholomew |
| 4,674,687 | A | 6/1987 | Smith et al. |
| 4,683,917 | A | 8/1987 | Bartholomew |
| 4,703,893 | A | 11/1987 | Gruber |
| 4,717,180 | A | 1/1988 | Roman |
| 4,719,654 | A | 1/1988 | Blessing |
| 4,733,337 | A | 3/1988 | Bieberstein |
| D295,437 | S | 4/1988 | Fabian |
| 4,739,801 | A | 4/1988 | Kimura et al. |
| 4,749,126 | A | 6/1988 | Kessener et al. |
| D296,582 | S | 7/1988 | Haug et al. |
| 4,754,928 | A | 7/1988 | Rogers et al. |
| D297,160 | S | 8/1988 | Robbins |
| 4,764,047 | A | 8/1988 | Johnston et al. |
| 4,778,104 | A | 10/1988 | Fisher |
| 4,787,591 | A | 11/1988 | Villacorta |
| 4,790,294 | A | 12/1988 | Allred, III et al. |
| 4,801,091 | A | 1/1989 | Sandvik |
| 4,809,369 | A | 3/1989 | Bowden |
| 4,839,599 | A | 6/1989 | Fischer |
| 4,842,059 | A | 6/1989 | Tomek |
| D302,325 | S | 7/1989 | Charet et al. |
| 4,850,616 | A | 7/1989 | Pava |
| 4,854,499 | A | 8/1989 | Neuman |
| 4,856,822 | A | 8/1989 | Parker |
| 4,865,362 | A | 9/1989 | Holden |
| D303,830 | S | 10/1989 | Ramsey et al. |
| 4,871,196 | A | 10/1989 | Kingsford |
| 4,896,658 | A | 1/1990 | Yonekubo et al. |
| D306,351 | S | 2/1990 | Charet et al. |
| 4,901,927 | A | 2/1990 | Valdivia |
| 4,903,178 | A | 2/1990 | Englot et al. |
| 4,903,897 | A | 2/1990 | Hayes |
| 4,903,922 | A | 2/1990 | Harris, III |
| 4,907,137 | A | 3/1990 | Schladitz et al. |
| 4,907,744 | A | 3/1990 | Jousson |
| 4,909,435 | A | 3/1990 | Kidouchi et al. |

(56) References Cited

U.S. PATENT DOCUMENTS

| | | | |
|---|---|---|---|
| 4,914,759 | A | 4/1990 | Goff |
| 4,946,202 | A | 8/1990 | Perricone |
| 4,951,329 | A | 8/1990 | Shaw |
| 4,953,585 | A | 9/1990 | Rollini et al. |
| 4,964,573 | A | 10/1990 | Lipski |
| 4,972,048 | A | 11/1990 | Martin |
| D313,267 | S | 12/1990 | Lenci et al. |
| 4,976,460 | A | 12/1990 | Newcombe et al. |
| D314,246 | S | 1/1991 | Bache |
| D315,191 | S | 3/1991 | Mikol |
| 4,998,673 | A | 3/1991 | Pilolla |
| 5,004,158 | A | 4/1991 | Halem et al. |
| D317,348 | S | 6/1991 | Geneve et al. |
| 5,020,570 | A | 6/1991 | Cotter |
| 5,022,103 | A | 6/1991 | Faist |
| 5,032,015 | A | 7/1991 | Christianson |
| 5,033,528 | A | 7/1991 | Volcani |
| 5,033,897 | A | 7/1991 | Chen |
| D319,294 | S | 8/1991 | Kohler, Jr. et al. |
| D320,064 | S | 9/1991 | Presman |
| 5,046,764 | A | 9/1991 | Kimura et al. |
| D321,062 | S | 10/1991 | Bonbright |
| 5,058,804 | A | 10/1991 | Yonekubo et al. |
| D322,119 | S | 12/1991 | Haug et al. |
| D322,681 | S | 12/1991 | Yuen |
| 5,070,552 | A | 12/1991 | Gentry et al. |
| D323,545 | S | 1/1992 | Ward |
| 5,082,019 | A | 1/1992 | Tetrault |
| 5,086,878 | A | 2/1992 | Swift |
| 5,090,624 | A | 2/1992 | Rogers |
| 5,100,055 | A | 3/1992 | Rokitenetz et al. |
| D325,769 | S | 4/1992 | Haug et al. |
| D325,770 | S | 4/1992 | Haug et al. |
| 5,103,384 | A | 4/1992 | Drohan |
| D326,311 | S | 5/1992 | Lenci et al. |
| D327,115 | S | 6/1992 | Rogers |
| 5,121,511 | A | 6/1992 | Sakamoto et al. |
| D327,729 | S | 7/1992 | Rogers |
| 5,127,580 | A | 7/1992 | Fu-I |
| 5,134,251 | A | 7/1992 | Martin |
| D328,944 | S | 8/1992 | Robbins |
| 5,141,016 | A | 8/1992 | Nowicki |
| D329,504 | S | 9/1992 | Yuen |
| 5,143,300 | A | 9/1992 | Cutler |
| 5,145,114 | A | 9/1992 | Monch |
| 5,148,556 | A | 9/1992 | Bottoms et al. |
| D330,068 | S | 10/1992 | Haug et al. |
| D330,408 | S | 10/1992 | Thacker |
| D330,409 | S | 10/1992 | Raffo |
| 5,153,976 | A | 10/1992 | Benchaar et al. |
| 5,154,355 | A | 10/1992 | Gonzalez |
| 5,154,483 | A | 10/1992 | Zeller |
| 5,161,567 | A | 11/1992 | Humpert |
| 5,163,752 | A | 11/1992 | Copeland et al. |
| 5,171,429 | A | 12/1992 | Yasuo |
| 5,172,860 | A | 12/1992 | Yuch |
| 5,172,862 | A | 12/1992 | Heimann et al. |
| 5,172,866 | A | 12/1992 | Ward |
| D332,303 | S | 1/1993 | Klose |
| D332,994 | S | 2/1993 | Huen |
| D333,339 | S | 2/1993 | Klose |
| 5,197,767 | A | 3/1993 | Kimura et al. |
| D334,794 | S | 4/1993 | Klose |
| D335,171 | S | 4/1993 | Lenci et al. |
| 5,201,468 | A | 4/1993 | Freier et al. |
| 5,206,963 | A | 5/1993 | Wiens |
| 5,207,499 | A | 5/1993 | Vajda et al. |
| 5,213,267 | A | 5/1993 | Heimann et al. |
| 5,220,697 | A | 6/1993 | Birchfield |
| D337,839 | S | 7/1993 | Zeller |
| 5,228,625 | A | 7/1993 | Grassberger |
| 5,230,106 | A | 7/1993 | Henkin et al. |
| D338,542 | S | 8/1993 | Yuen |
| 5,232,162 | A | 8/1993 | Chih |
| D339,492 | S | 9/1993 | Klose |
| D339,627 | S | 9/1993 | Klose |
| D339,848 | S | 9/1993 | Gottwald |
| 5,246,169 | A | 9/1993 | Heimann et al. |
| 5,246,301 | A | 9/1993 | Hirasawa |
| D340,376 | S | 10/1993 | Klose |
| 5,253,670 | A | 10/1993 | Perrott |
| 5,253,807 | A | 10/1993 | Newbegin |
| 5,254,809 | A | 10/1993 | Martin |
| D341,007 | S | 11/1993 | Haug et al. |
| D341,191 | S | 11/1993 | Klose |
| D341,220 | S | 11/1993 | Eagan |
| 5,263,646 | A | 11/1993 | McCauley |
| 5,265,833 | A | 11/1993 | Heimann et al. |
| 5,268,826 | A | 12/1993 | Greene |
| 5,276,596 | A | 1/1994 | Krenzel |
| 5,277,391 | A | 1/1994 | Haug et al. |
| 5,286,071 | A | 2/1994 | Storage |
| 5,288,110 | A | 2/1994 | Allread |
| 5,294,054 | A | 3/1994 | Benedict et al. |
| 5,297,735 | A | 3/1994 | Heimann et al. |
| 5,297,739 | A | 3/1994 | Allen |
| D345,811 | S | 4/1994 | Van Deursen et al. |
| D346,426 | S | 4/1994 | Warshawsky |
| D346,428 | S | 4/1994 | Warshawsky |
| D346,430 | S | 4/1994 | Warshawsky |
| D347,262 | S | 5/1994 | Black et al. |
| D347,265 | S | 5/1994 | Gottwald |
| 5,316,216 | A | 5/1994 | Cammack et al. |
| D348,720 | S | 7/1994 | Haug et al. |
| 5,329,650 | A | 7/1994 | Zaccai et al. |
| D349,947 | S | 8/1994 | Hing-Wah |
| 5,333,787 | A | 8/1994 | Smith et al. |
| 5,333,789 | A | 8/1994 | Garneys |
| 5,340,064 | A | 8/1994 | Heimann et al. |
| 5,340,165 | A | 8/1994 | Sheppard |
| D350,808 | S | 9/1994 | Warshawsky |
| 5,344,080 | A | 9/1994 | Matsui |
| 5,349,987 | A | 9/1994 | Shieh |
| 5,356,076 | A | 10/1994 | Bishop |
| 5,356,077 | A | 10/1994 | Shames |
| D352,092 | S | 11/1994 | Warshawsky |
| D352,347 | S | 11/1994 | Dannenberg |
| D352,766 | S | 11/1994 | Hill et al. |
| 5,368,235 | A | 11/1994 | Drozdoff et al. |
| 5,369,556 | A | 11/1994 | Zeller |
| 5,370,427 | A | 12/1994 | Hoelle et al. |
| 5,385,500 | A | 1/1995 | Schmidt |
| D355,242 | S | 2/1995 | Warshawsky |
| D355,703 | S | 2/1995 | Duell |
| D356,626 | S | 3/1995 | Wang |
| 5,397,064 | A | 3/1995 | Heitzman |
| 5,398,872 | A | 3/1995 | Joubran |
| 5,398,977 | A | 3/1995 | Berger et al. |
| 5,402,812 | A | 4/1995 | Moineau et al. |
| 5,405,089 | A | 4/1995 | Heimann et al. |
| 5,414,879 | A | 5/1995 | Hiraishi et al. |
| 5,423,348 | A | 6/1995 | Jezek et al. |
| 5,433,384 | A | 7/1995 | Chan et al. |
| D361,399 | S | 8/1995 | Carbone et al. |
| D361,623 | S | 8/1995 | Huen |
| 5,441,075 | A | 8/1995 | Clare |
| 5,449,206 | A | 9/1995 | Lockwood |
| D363,360 | S | 10/1995 | Santarsiero |
| 5,454,809 | A | 10/1995 | Janssen |
| 5,468,057 | A | 11/1995 | Megerle et al. |
| D364,935 | S | 12/1995 | deBlois |
| D365,625 | S | 12/1995 | Bova |
| D365,646 | S | 12/1995 | deBlois |
| 5,476,225 | A | 12/1995 | Chan |
| D366,309 | S | 1/1996 | Huang |
| D366,707 | S | 1/1996 | Kaiser |
| D366,708 | S | 1/1996 | Santarsiero |
| D366,709 | S | 1/1996 | Szymanski |
| D366,710 | S | 1/1996 | Szymanski |
| 5,481,765 | A | 1/1996 | Wang |
| D366,948 | S | 2/1996 | Carbone |
| D367,315 | S | 2/1996 | Andrus |
| D367,333 | S | 2/1996 | Swyst |
| D367,696 | S | 3/1996 | Andrus |

(56) References Cited

U.S. PATENT DOCUMENTS

| | | | |
|---|---|---|---|
| D367,934 | S | 3/1996 | Carbone |
| D368,146 | S | 3/1996 | Carbone |
| D368,317 | S | 3/1996 | Swyst |
| 5,499,767 | A | 3/1996 | Morand |
| D368,539 | S | 4/1996 | Carbone et al. |
| D368,540 | S | 4/1996 | Santarsiero |
| D368,541 | S | 4/1996 | Kaiser et al. |
| D368,542 | S | 4/1996 | deBlois et al. |
| D369,204 | S | 4/1996 | Andrus |
| D369,205 | S | 4/1996 | Andrus |
| 5,507,436 | A | 4/1996 | Ruttenberg |
| D369,873 | S | 5/1996 | deBlois et al. |
| D369,874 | S | 5/1996 | Santarsiero |
| D369,875 | S | 5/1996 | Carbone |
| D370,052 | S | 5/1996 | Chan et al. |
| D370,250 | S | 5/1996 | Fawcett et al. |
| D370,277 | S | 5/1996 | Kaiser |
| D370,278 | S | 5/1996 | Nolan |
| D370,279 | S | 5/1996 | deBlois |
| D370,280 | S | 5/1996 | Kaiser |
| D370,281 | S | 5/1996 | Johnstone et al. |
| 5,517,392 | A | 5/1996 | Rousso et al. |
| 5,521,803 | A | 5/1996 | Eckert et al. |
| D370,542 | S | 6/1996 | Santarsiero |
| D370,735 | S | 6/1996 | deBlois |
| D370,987 | S | 6/1996 | Santarsiero |
| D370,988 | S | 6/1996 | Santarsiero |
| D371,448 | S | 7/1996 | Santarsiero |
| D371,618 | S | 7/1996 | Nolan |
| D371,619 | S | 7/1996 | Szymanski |
| D371,856 | S | 7/1996 | Carbone |
| D372,318 | S | 7/1996 | Szymanski |
| D372,319 | S | 7/1996 | Carbone |
| 5,531,625 | A | 7/1996 | Zhong |
| 5,539,624 | A | 7/1996 | Dougherty |
| D372,548 | S | 8/1996 | Carbone |
| D372,998 | S | 8/1996 | Carbone |
| D373,210 | S | 8/1996 | Santarsiero |
| D373,434 | S | 9/1996 | Nolan |
| D373,435 | S | 9/1996 | Nolan |
| D373,645 | S | 9/1996 | Johnstone et al. |
| D373,646 | S | 9/1996 | Szymanski et al. |
| D373,647 | S | 9/1996 | Kaiser |
| D373,648 | S | 9/1996 | Kaiser |
| D373,649 | S | 9/1996 | Carbone |
| D373,651 | S | 9/1996 | Szymanski |
| D373,652 | S | 9/1996 | Kaiser |
| 5,551,637 | A | 9/1996 | Lo |
| 5,552,973 | A | 9/1996 | Hsu |
| 5,558,278 | A | 9/1996 | Gallorini |
| D374,271 | S | 10/1996 | Fleischmann |
| D374,297 | S | 10/1996 | Kaiser |
| D374,298 | S | 10/1996 | Swyst |
| D374,299 | S | 10/1996 | Carbone |
| D374,493 | S | 10/1996 | Szymanski |
| D374,494 | S | 10/1996 | Santarsiero |
| D374,732 | S | 10/1996 | Kaiser |
| D374,733 | S | 10/1996 | Santasiero |
| 5,560,548 | A | 10/1996 | Mueller et al. |
| 5,567,115 | A | 10/1996 | Carbone |
| D375,541 | S | 11/1996 | Michaluk |
| 5,577,664 | A | 11/1996 | Heitzman |
| D376,217 | S | 12/1996 | Kaiser |
| D376,860 | S | 12/1996 | Santarsiero |
| D376,861 | S | 12/1996 | Johnstone et al. |
| D376,862 | S | 12/1996 | Carbone |
| 5,605,173 | A | 2/1997 | Arnaud |
| D378,401 | S | 3/1997 | Neufeld et al. |
| 5,613,638 | A | 3/1997 | Blessing |
| 5,613,639 | A | 3/1997 | Storm et al. |
| 5,615,837 | A | 4/1997 | Roman |
| 5,624,074 | A | 4/1997 | Parisi |
| 5,624,498 | A | 4/1997 | Lee et al. |
| D379,212 | S | 5/1997 | Chan |
| D379,404 | S | 5/1997 | Spelts |
| 5,632,049 | A | 5/1997 | Chen |
| D381,405 | S | 7/1997 | Waidele et al. |
| D381,737 | S | 7/1997 | Chan |
| D382,936 | S | 8/1997 | Shfaram |
| 5,653,260 | A | 8/1997 | Huber |
| 5,667,146 | A | 9/1997 | Pimentel et al. |
| D385,332 | S | 10/1997 | Andrus |
| D385,333 | S | 10/1997 | Caroen et al. |
| D385,334 | S | 10/1997 | Caroen et al. |
| D385,616 | S | 10/1997 | Dow et al. |
| D385,947 | S | 11/1997 | Dow et al. |
| D387,230 | S | 12/1997 | von Buelow et al. |
| 5,697,557 | A | 12/1997 | Blessing et al. |
| 5,699,964 | A | 12/1997 | Bergmann et al. |
| 5,702,057 | A | 12/1997 | Huber |
| D389,558 | S | 1/1998 | Andrus |
| 5,704,080 | A | 1/1998 | Kuhne |
| 5,707,011 | A | 1/1998 | Bosio |
| 5,718,380 | A | 2/1998 | Schorn et al. |
| D392,369 | S | 3/1998 | Chan |
| 5,730,361 | A | 3/1998 | Thonnes |
| 5,730,362 | A | 3/1998 | Cordes |
| 5,730,363 | A | 3/1998 | Kress |
| 5,742,961 | A | 4/1998 | Casperson et al. |
| D394,490 | S | 5/1998 | Andrus et al. |
| 5,746,375 | A | 5/1998 | Guo |
| 5,749,552 | A | 5/1998 | Fan |
| 5,749,602 | A | 5/1998 | Delaney et al. |
| D394,899 | S | 6/1998 | Caroen et al. |
| D395,074 | S | 6/1998 | Neibrook et al. |
| D395,075 | S | 6/1998 | Kolada |
| D395,142 | S | 6/1998 | Neibrook |
| 5,764,760 | A | 6/1998 | Grandbert et al. |
| 5,765,760 | A | 6/1998 | Kuo |
| 5,769,802 | A | 6/1998 | Wang |
| 5,772,120 | A | 6/1998 | Huber |
| 5,778,939 | A | 7/1998 | Hok-Yin |
| 5,788,157 | A | 8/1998 | Kress |
| D398,370 | S | 9/1998 | Purdy |
| 5,806,771 | A | 9/1998 | Loschelder et al. |
| 5,819,791 | A | 10/1998 | Chronister et al. |
| 5,820,574 | A | 10/1998 | Henkin et al. |
| 5,823,431 | A | 10/1998 | Pierce |
| 5,823,442 | A | 10/1998 | Guo |
| 5,826,803 | A | 10/1998 | Cooper |
| 5,833,138 | A | 11/1998 | Crane et al. |
| 5,839,666 | A | 11/1998 | Heimann et al. |
| D402,350 | S | 12/1998 | Andrus |
| D403,754 | S | 1/1999 | Gottwald |
| D404,116 | S | 1/1999 | Bosio |
| 5,855,348 | A | 1/1999 | Fornara |
| 5,860,599 | A | 1/1999 | Lin |
| 5,862,543 | A | 1/1999 | Reynoso et al. |
| 5,862,985 | A | 1/1999 | Neibrook et al. |
| D405,502 | S | 2/1999 | Tse |
| 5,865,375 | A | 2/1999 | Hsu |
| 5,865,378 | A | 2/1999 | Hollinshead et al. |
| 5,873,647 | A | 2/1999 | Kurtz et al. |
| D408,893 | S | 4/1999 | Tse |
| D409,276 | S | 5/1999 | Ratzlaff |
| D410,276 | S | 5/1999 | Ben-Tsur |
| 5,918,809 | A | 7/1999 | Simmons |
| 5,918,811 | A | 7/1999 | Denham et al. |
| D413,157 | S | 8/1999 | Ratzlaff |
| 5,937,905 | A | 8/1999 | Santos |
| 5,938,123 | A | 8/1999 | Heitzman |
| 5,941,462 | A | 8/1999 | Sandor |
| 5,947,388 | A | 9/1999 | Woodruff |
| D415,247 | S | 10/1999 | Haverstraw et al. |
| 5,961,046 | A | 10/1999 | Joubran |
| 5,967,417 | A | 10/1999 | Mantel |
| 5,979,776 | A | 11/1999 | Williams |
| 5,992,762 | A | 11/1999 | Wang |
| D418,200 | S | 12/1999 | Ben-Tsur |
| 5,997,047 | A | 12/1999 | Pimentel et al. |
| 6,003,165 | A | 12/1999 | Loyd |
| D418,902 | S | 1/2000 | Haverstraw et al. |
| D418,903 | S | 1/2000 | Haverstraw et al. |
| D418,904 | S | 1/2000 | Milrud |

(56) References Cited

U.S. PATENT DOCUMENTS

| | | | | |
|---|---|---|---|---|
| D421,099 | S | 2/2000 | Mullenmeister | |
| 6,021,960 | A | 2/2000 | Kehat | |
| D422,053 | S | 3/2000 | Brenner et al. | |
| 6,042,027 | A | 3/2000 | Sandvik | |
| 6,042,155 | A | 3/2000 | Lockwood | |
| D422,336 | S | 4/2000 | Haverstraw et al. | |
| D422,337 | S | 4/2000 | Chan | |
| D423,083 | S | 4/2000 | Haug et al. | |
| D423,110 | S | 4/2000 | Cipkowski | |
| D424,160 | S | 5/2000 | Haug et al. | |
| D424,161 | S | 5/2000 | Haug et al. | |
| D424,162 | S | 5/2000 | Haug et al. | |
| D424,163 | S | 5/2000 | Haug et al. | |
| D426,290 | S | 6/2000 | Haug et al. | |
| D427,661 | S | 7/2000 | Haverstraw et al. | |
| D428,110 | S | 7/2000 | Haug et al. | |
| D428,125 | S | 7/2000 | Chan | |
| 6,085,780 | A | 7/2000 | Morris | |
| D430,267 | S | 8/2000 | Milrud et al. | |
| 6,095,801 | A | 8/2000 | Spiewak | |
| D430,643 | S | 9/2000 | Tse | |
| 6,113,002 | A | 9/2000 | Finkbeiner | |
| 6,123,272 | A | 9/2000 | Havican et al. | |
| 6,123,308 | A | 9/2000 | Faisst | |
| D432,624 | S | 10/2000 | Chan | |
| D432,625 | S | 10/2000 | Chan | |
| D433,096 | S | 10/2000 | Tse | |
| D433,097 | S | 10/2000 | Tse | |
| 6,126,091 | A | 10/2000 | Heitzman | |
| 6,126,290 | A | 10/2000 | Veigel | |
| D434,109 | S | 11/2000 | Ko | |
| 6,164,569 | A | 12/2000 | Hollinshead et al. | |
| 6,164,570 | A | 12/2000 | Smeltzer | |
| D435,889 | S | 1/2001 | Ben-Tsur et al. | |
| D439,305 | S | 3/2001 | Slothower | |
| 6,199,580 | B1 | 3/2001 | Morris | |
| 6,202,679 | B1 | 3/2001 | Titus | |
| D440,276 | S | 4/2001 | Slothower | |
| D440,277 | S | 4/2001 | Slothower | |
| D440,278 | S | 4/2001 | Slothower | |
| D441,059 | S | 4/2001 | Fleischmann | |
| 6,209,799 | B1 | 4/2001 | Finkbeiner | |
| D443,025 | S | 5/2001 | Kollmann et al. | |
| D443,026 | S | 5/2001 | Kollmann et al. | |
| D443,027 | S | 5/2001 | Kollmann et al. | |
| D443,029 | S | 5/2001 | Kollmann et al. | |
| 6,223,998 | B1 | 5/2001 | Heitzman | |
| 6,230,984 | B1 | 5/2001 | Jager | |
| 6,230,988 | B1 | 5/2001 | Chao | |
| 6,230,989 | B1 * | 5/2001 | Haverstraw et al. | 239/443 |
| D443,335 | S | 6/2001 | Andrus | |
| D443,336 | S | 6/2001 | Kollmann et al. | |
| D443,347 | S | 6/2001 | Gottwald | |
| 6,241,166 | B1 | 6/2001 | Overington et al. | |
| 6,250,572 | B1 | 6/2001 | Chen | |
| D444,865 | S | 7/2001 | Gottwald | |
| D445,871 | S | 7/2001 | Fan | |
| 6,254,014 | B1 | 7/2001 | Clearman et al. | |
| 6,270,278 | B1 | 8/2001 | Mauro | |
| 6,276,004 | B1 | 8/2001 | Bertrand et al. | |
| 6,283,447 | B1 | 9/2001 | Fleet | |
| 6,286,764 | B1 | 9/2001 | Garvey et al. | |
| D449,673 | S | 10/2001 | Kollmann et al. | |
| D450,370 | S | 11/2001 | Wales et al. | |
| D450,805 | S | 11/2001 | Lindholm et al. | |
| D450,806 | S | 11/2001 | Lindholm et al. | |
| D450,807 | S | 11/2001 | Lindholm et al. | |
| D451,169 | S | 11/2001 | Lindholm et al. | |
| D451,170 | S | 11/2001 | Lindholm et al. | |
| D451,171 | S | 11/2001 | Lindholm et al. | |
| D451,172 | S | 11/2001 | Lindholm et al. | |
| 6,321,777 | B1 | 11/2001 | Wu | |
| 6,322,006 | B1 | 11/2001 | Guo | |
| D451,583 | S | 12/2001 | Lindholm et al. | |
| D451,980 | S | 12/2001 | Lindholm et al. | |
| D452,553 | S | 12/2001 | Lindholm et al. | |
| D452,725 | S | 1/2002 | Lindholm et al. | |
| D452,897 | S | 1/2002 | Gillette et al. | |
| 6,336,764 | B1 | 1/2002 | Liu | |
| D453,369 | S | 2/2002 | Lobermeier | |
| D453,370 | S | 2/2002 | Lindholm et al. | |
| D453,551 | S | 2/2002 | Lindholm et al. | |
| 6,349,735 | B2 | 2/2002 | Gul | |
| D454,617 | S | 3/2002 | Curbbun et al. | |
| D454,938 | S | 3/2002 | Lord | |
| 6,375,342 | B1 | 4/2002 | Koren et al. | |
| D457,937 | S | 5/2002 | Lindholm et al. | |
| 6,382,531 | B1 | 5/2002 | Tracy | |
| D458,348 | S | 6/2002 | Mullenmeister | |
| 6,412,711 | B1 | 7/2002 | Fan | |
| D461,224 | S | 8/2002 | Lobermeier | |
| D461,878 | S | 8/2002 | Green et al. | |
| 6,450,425 | B1 | 9/2002 | Chen | |
| 6,454,186 | B2 | 9/2002 | Haverstraw et al. | |
| 6,463,658 | B1 | 10/2002 | Larsson | |
| 6,464,265 | B1 | 10/2002 | Mikol | |
| D465,552 | S | 11/2002 | Tse | |
| D465,553 | S | 11/2002 | Singtoroj | |
| 6,484,952 | B2 | 11/2002 | Koren | |
| D468,800 | S | 1/2003 | Tse | |
| D469,165 | S | 1/2003 | Lim | |
| 6,502,796 | B1 | 1/2003 | Wales | |
| 6,508,415 | B2 | 1/2003 | Wang | |
| 6,511,001 | B1 | 1/2003 | Huang | |
| D470,219 | S | 2/2003 | Schweitzer | |
| 6,516,070 | B2 | 2/2003 | Macey | |
| D471,253 | S | 3/2003 | Tse | |
| D471,953 | S | 3/2003 | Colligan et al. | |
| 6,533,194 | B2 | 3/2003 | Marsh et al. | |
| 6,537,455 | B2 | 3/2003 | Farley | |
| D472,958 | S | 4/2003 | Ouyoung | |
| 6,550,697 | B2 | 4/2003 | Lai | |
| 6,585,174 | B1 | 7/2003 | Huang | |
| 6,595,439 | B1 | 7/2003 | Chen | |
| 6,607,148 | B1 | 8/2003 | Marsh et al. | |
| 6,611,971 | B1 | 9/2003 | Antoniello et al. | |
| 6,637,676 | B2 | 10/2003 | Zieger et al. | |
| 6,641,057 | B2 | 11/2003 | Thomas et al. | |
| D483,837 | S | 12/2003 | Fan | |
| 6,659,117 | B2 | 12/2003 | Gilmore | |
| 6,659,372 | B2 | 12/2003 | Marsh et al. | |
| D485,887 | S | 1/2004 | Luettgen et al. | |
| D486,888 | S | 2/2004 | Lobermeier | |
| 6,691,338 | B2 | 2/2004 | Zieger | |
| 6,691,933 | B1 | 2/2004 | Bosio | |
| D487,301 | S | 3/2004 | Haug et al. | |
| D487,498 | S | 3/2004 | Blomstrom | |
| 6,701,953 | B2 | 3/2004 | Agosta | |
| 6,715,699 | B1 | 4/2004 | Greenberg et al. | |
| 6,719,218 | B2 | 4/2004 | Cool et al. | |
| D489,798 | S | 5/2004 | Hunt | |
| D490,498 | S | 5/2004 | Golichowski | |
| 6,736,336 | B2 | 5/2004 | Wong | |
| 6,739,523 | B2 | 5/2004 | Haverstraw et al. | |
| 6,739,527 | B1 | 5/2004 | Chung | |
| D492,004 | S | 6/2004 | Haug et al. | |
| D492,007 | S | 6/2004 | Kollmann et al. | |
| 6,742,725 | B1 | 6/2004 | Fan | |
| D493,208 | S | 7/2004 | Lin | |
| D493,864 | S | 8/2004 | Haug et al. | |
| D494,655 | S | 8/2004 | Lin | |
| D494,661 | S | 8/2004 | Zieger et al. | |
| D495,027 | S | 8/2004 | Mazzola | |
| 6,776,357 | B1 | 8/2004 | Naito | |
| 6,789,751 | B1 | 9/2004 | Fan | |
| D496,987 | S | 10/2004 | Glunk | |
| D497,974 | S | 11/2004 | Haug et al. | |
| D498,514 | S | 11/2004 | Haug et al. | |
| D500,121 | S | 12/2004 | Blomstrom | |
| D500,549 | S | 1/2005 | Blomstrom | |
| D500,839 | S | 1/2005 | Blomstrom | |
| D501,242 | S | 1/2005 | Blomstrom | |
| D502,760 | S | 3/2005 | Zieger et al. | |
| D502,761 | S | 3/2005 | Zieger et al. | |

(56) References Cited

U.S. PATENT DOCUMENTS

| | | | |
|---|---|---|---|
| D503,211 | S | 3/2005 | Lin |
| 6,863,227 | B2 | 3/2005 | Wollenberg et al. |
| 6,869,030 | B2 | 3/2005 | Blessing et al. |
| D503,774 | S | 4/2005 | Zieger |
| D503,775 | S | 4/2005 | Zieger |
| D503,966 | S | 4/2005 | Zieger |
| 6,899,292 | B2 | 5/2005 | Titinet |
| D506,243 | S | 6/2005 | Wu |
| D507,037 | S | 7/2005 | Wu |
| 6,935,581 | B2 | 8/2005 | Titinet |
| D509,280 | S | 9/2005 | Bailey et al. |
| D509,563 | S | 9/2005 | Bailey et al. |
| D510,123 | S | 9/2005 | Tsai |
| D511,809 | S | 11/2005 | Haug et al. |
| D512,119 | S | 11/2005 | Haug et al. |
| 6,981,661 | B1 | 1/2006 | Chen |
| D516,169 | S | 2/2006 | Wu |
| 7,000,854 | B2 | 2/2006 | Malek et al. |
| 7,004,409 | B2 | 2/2006 | Okubo |
| 7,004,410 | B2 | 2/2006 | Li |
| D520,109 | S | 5/2006 | Wu |
| 7,040,554 | B2 | 5/2006 | Drennow |
| 7,048,210 | B2 | 5/2006 | Clark |
| 7,055,767 | B1 | 6/2006 | Ko |
| 7,070,125 | B2 | 7/2006 | Williams et al. |
| 7,077,342 | B2 | 7/2006 | Lee |
| D527,440 | S | 8/2006 | Macan |
| 7,093,780 | B1 | 8/2006 | Chung |
| 7,097,122 | B1 | 8/2006 | Farley |
| D528,631 | S | 9/2006 | Gillette et al. |
| 7,100,845 | B1 * | 9/2006 | Hsieh ..... 239/447 |
| 7,111,795 | B2 | 9/2006 | Thong |
| 7,111,798 | B2 | 9/2006 | Thomas et al. |
| D530,389 | S | 10/2006 | Genslak et al. |
| D530,392 | S | 10/2006 | Tse |
| D531,259 | S | 10/2006 | Hsieh |
| 7,114,666 | B2 | 10/2006 | Luettgen et al. |
| D533,253 | S | 12/2006 | Luettgen et al. |
| D534,239 | S | 12/2006 | Dingler et al. |
| D535,354 | S | 1/2007 | Wu |
| D536,060 | S | 1/2007 | Sadler |
| 7,156,325 | B1 | 1/2007 | Chen |
| D538,391 | S | 3/2007 | Mazzola |
| D540,424 | S | 4/2007 | Kirar |
| D540,425 | S | 4/2007 | Endo et al. |
| D540,426 | S | 4/2007 | Cropelli |
| D540,427 | S | 4/2007 | Bouroullec et al. |
| D542,391 | S | 5/2007 | Gilbert |
| D542,393 | S | 5/2007 | Haug et al. |
| 7,229,031 | B2 | 6/2007 | Schmidt |
| 7,243,863 | B2 | 7/2007 | Glunk |
| 7,246,760 | B2 | 7/2007 | Marty et al. |
| D552,713 | S | 10/2007 | Rexach |
| 7,278,591 | B2 | 10/2007 | Clearman et al. |
| D556,295 | S | 11/2007 | Genord et al. |
| 7,299,510 | B2 | 11/2007 | Tsai |
| D557,763 | S | 12/2007 | Schonherr et al. |
| D557,764 | S | 12/2007 | Schonherr et al. |
| D557,765 | S | 12/2007 | Schonherr et al. |
| D558,301 | S | 12/2007 | Hoernig |
| 7,303,151 | B2 | 12/2007 | Wu |
| D559,357 | S | 1/2008 | Wang et al. |
| D559,945 | S | 1/2008 | Patterson et al. |
| D560,269 | S | 1/2008 | Tse |
| D562,937 | S | 2/2008 | Schonherr et al. |
| D562,938 | S | 2/2008 | Blessing |
| D562,941 | S | 2/2008 | Pan |
| 7,331,536 | B1 | 2/2008 | Zhen et al. |
| 7,347,388 | B2 | 3/2008 | Chung |
| D565,699 | S | 4/2008 | Berberet |
| D565,702 | S | 4/2008 | Daunter et al. |
| D565,703 | S | 4/2008 | Lammel et al. |
| D566,228 | S | 4/2008 | Neagoe |
| D566,229 | S | 4/2008 | Rexach |
| D567,328 | S | 4/2008 | Spangler et al. |
| 7,360,723 | B2 | 4/2008 | Lev |
| 7,364,097 | B2 | 4/2008 | Okuma |
| 7,374,112 | B1 | 5/2008 | Bulan et al. |
| 7,384,007 | B2 | 6/2008 | Ho |
| D577,099 | S | 9/2008 | Leber |
| D577,793 | S | 9/2008 | Leber |
| D580,012 | S | 11/2008 | Quinn et al. |
| D580,513 | S | 11/2008 | Quinn et al. |
| D581,013 | S | 11/2008 | Citterio |
| D581,014 | S | 11/2008 | Quinn et al. |
| 7,503,345 | B2 | 3/2009 | Paterson et al. |
| D590,048 | S | 4/2009 | Leber et al. |
| 7,520,448 | B2 | 4/2009 | Luettgen et al. |
| D592,276 | S | 5/2009 | Schoenherr et al. |
| D592,278 | S | 5/2009 | Leber |
| 7,537,175 | B2 | 5/2009 | Miura et al. |
| D603,935 | S | 11/2009 | Leber |
| 7,617,990 | B2 | 11/2009 | Huffman |
| D605,731 | S | 12/2009 | Leber |
| 7,721,979 | B2 | 5/2010 | Mazzola |
| 7,740,186 | B2 | 6/2010 | Macan et al. |
| 7,770,820 | B2 | 8/2010 | Clearman et al. |
| D624,156 | S | 9/2010 | Leber |
| 7,789,326 | B2 | 9/2010 | Luettgen et al. |
| 7,832,662 | B2 | 11/2010 | Gallo |
| 8,020,787 | B2 | 9/2011 | Leber |
| 8,020,788 | B2 | 9/2011 | Luettgen et al. |
| 8,028,935 | B2 | 10/2011 | Leber |
| 8,109,450 | B2 | 2/2012 | Luettgen et al. |
| 8,132,745 | B2 | 3/2012 | Leber et al. |
| 8,146,838 | B2 | 4/2012 | Luettgen et al. |
| 8,292,200 | B2 | 10/2012 | Macan et al. |
| 8,348,181 | B2 | 1/2013 | Whitaker |
| 2002/0109023 | A1 | 8/2002 | Thomas et al. |
| 2003/0062426 | A1 | 4/2003 | Gregory et al. |
| 2003/0121993 | A1 | 7/2003 | Haverstraw et al. |
| 2004/0074993 | A1 | 4/2004 | Thomas et al. |
| 2004/0118949 | A1 | 6/2004 | Marks |
| 2004/0217209 | A1 | 11/2004 | Bui |
| 2004/0244105 | A1 | 12/2004 | Tsai |
| 2005/0001072 | A1 | 1/2005 | Bolus et al. |
| 2005/0284967 | A1 | 12/2005 | Korb |
| 2006/0016908 | A1 | 1/2006 | Chung |
| 2006/0016913 | A1 | 1/2006 | Lo |
| 2006/0102747 | A1 | 5/2006 | Ho |
| 2006/0163391 | A1 | 7/2006 | Schorn |
| 2006/0219822 | A1 | 10/2006 | Miller et al. |
| 2007/0040054 | A1 | 2/2007 | Farzan |
| 2007/0200013 | A1 | 8/2007 | Hsiao |
| 2007/0246577 | A1 | 10/2007 | Leber |
| 2007/0252021 | A1 | 11/2007 | Cristina |
| 2007/0272770 | A1 | 11/2007 | Leber et al. |
| 2008/0073449 | A1 | 3/2008 | Haynes et al. |
| 2008/0083844 | A1 | 4/2008 | Leber et al. |
| 2008/0121293 | A1 | 5/2008 | Leber et al. |
| 2008/0156897 | A1 | 7/2008 | Leber |
| 2008/0223957 | A1 | 9/2008 | Schorn |
| 2008/0272591 | A1 | 11/2008 | Leber |
| 2009/0218420 | A1 | 9/2009 | Mazzola |
| 2009/0307836 | A1 | 12/2009 | Blattner et al. |
| 2010/0127096 | A1 | 5/2010 | Leber |
| 2011/0011953 | A1 | 1/2011 | Macan et al. |
| 2011/0121098 | A1 | 5/2011 | Luettgen et al. |
| 2013/0147186 | A1 | 6/2013 | Leber |

FOREIGN PATENT DOCUMENTS

| | | |
|---|---|---|
| CH | 234284 | 3/1963 |
| DE | 352813 | 5/1922 |
| DE | 848627 | 9/1952 |
| DE | 854100 | 10/1952 |
| DE | 2360534 | 6/1974 |
| DE | 2806093 | 8/1979 |
| DE | 3107808 | 9/1982 |
| DE | 3246327 | 6/1984 |
| DE | 3440901 | 7/1985 |
| DE | 3706320 | 3/1988 |
| DE | 8804236 | 6/1988 |
| DE | 4034695 | 5/1991 |

(56) References Cited

FOREIGN PATENT DOCUMENTS

| | | |
|---|---|---|
| DE | 19608085 | 9/1996 |
| DE | 202005000881 | 3/2005 |
| DE | 102006032017 | 1/2008 |
| EP | 0167063 | 6/1985 |
| EP | 0478999 | 4/1992 |
| EP | 0514753 | 11/1992 |
| EP | 0435030 | 7/1993 |
| EP | 0617644 | 10/1994 |
| EP | 0683354 | 11/1995 |
| EP | 0687851 | 12/1995 |
| EP | 0695907 | 2/1996 |
| EP | 0700729 | 3/1996 |
| EP | 0719588 | 7/1996 |
| EP | 0721082 | 7/1996 |
| EP | 0733747 | 9/1996 |
| EP | 0808661 | 11/1997 |
| EP | 0726811 | 1/1998 |
| EP | 2164642 | 10/2010 |
| FR | 538538 | 6/1922 |
| FR | 873808 | 7/1942 |
| FR | 1039750 | 10/1953 |
| FR | 1098836 | 8/1955 |
| FR | 2596492 | 10/1987 |
| FR | 2695452 | 3/1994 |
| GB | 3314 | 0/1914 |
| GB | 10086 | 0/1894 |
| GB | 129812 | 7/1919 |
| GB | 204600 | 10/1923 |
| GB | 634483 | 3/1950 |
| GB | 971866 | 10/1964 |
| GB | 1111126 | 4/1968 |
| GB | 2066074 | 1/1980 |
| GB | 2066704 | 7/1981 |
| GB | 2068778 | 8/1981 |
| GB | 2121319 | 12/1983 |
| GB | 2155984 | 10/1985 |
| GB | 2156932 A | 10/1985 |
| GB | 2199771 | 7/1988 |
| GB | 2298595 | 11/1996 |
| GB | 2337471 | 11/1999 |
| IT | 327400 | 7/1935 |
| IT | 350359 | 7/1937 |
| IT | 563459 | 5/1957 |
| JP | S63-181459 | 11/1988 |
| JP | H2-78660 | 6/1990 |
| JP | 4062238 | 2/1992 |
| JP | 4146708 | 5/1992 |
| NL | 8902957 | 6/1991 |
| WO | WO93/12894 | 7/1993 |
| WO | WO93/25839 | 12/1993 |
| WO | WO96/00617 | 1/1996 |
| WO | WO98/30336 | 7/1998 |
| WO | WO99/59726 | 11/1999 |
| WO | WO00/10720 | 3/2000 |
| WO | WO2010/004593 | 1/2010 |

OTHER PUBLICATIONS

Color Copy, Labeled 1B, Gemlo, available at least as early as Dec. 2, 1998.

* cited by examiner

SHOWERHEAD WITH FLOW DIRECTING PLATES AND RADIAL MODE CHANGER

CROSS-REFERENCE TO RELATED APPLICATIONS

This application is a divisional of U.S. application Ser. No. 12/560,041, filed Sep. 15, 2009, and entitled "Shower Assembly with Radial Mode Change," which claims priority to U.S. Provisional Application Ser. No. 61/097,069, filed Sep. 15, 2008, and entitled "Shower Assembly with Radial Mode Changer," both of which are incorporated herein by reference in their entirety.

TECHNICAL FIELD

The technology disclosed herein relates to shower assemblies having several different spray modes.

BACKGROUND

Multi-function shower heads have a plurality of spray modes, including various standard sprays and pulsed sprays. Typically, the spray mode is selected using a control ring positioned around the circumference of the shower head, and moveable with respect to the shower head. The ring is rotated around the shower head to select the desired spray mode. Several problems result from such shower heads. For example, adjusting the control ring structure often requires the user to handle the control ring across the face of the shower head, thereby interfering with the flow from the shower head and producing undesired splashing. Using the control ring may also cause the orientation of the spray head to be adjusted inadvertently. Additionally, such shower heads require that the shape of the shower head be substantially round, and limit the amount of surface area available on the shower head for spray nozzles Accordingly, a multi-function shower head having a convenient mechanism for selecting spray modes may be provided to address these deficiencies. In addition, a multi-function shower head may allow for flexibility in styling and/or shaping of the shower head. Further, a multi-function shower head may provide an increased surface area available for spray nozzles relative to other shower heads having the same or similar diameter or surface area.

SUMMARY

In one embodiment, a showerhead having a plurality of spray modes including a manifold defining a plurality of mode apertures, a front channel plate, a rear channel plate, and a radial mode changer is disclosed. The front channel plate includes a plurality of front plate partitions connected to an exterior surface of the manifold. The front plate partitions define at least two channels, each channel of the at least two channels corresponds to one of the plurality of spray modes. The mode apertures in the manifold provide fluid communication between the manifold and the at least two channels. The rear channel plate encloses the at least two channels to form at least two chambers. When the radial mode changer is rotated, one or more of the ports of the radial mode changer is aligned with one or more of the mode apertures, and water flows through the radial mode changer into one of the chambers.

In another embodiment, a showerhead having a plurality of spray modes is disclosed. The showerhead includes a manifold, a first plate, a second plate, and a radial mode changer. The manifold having two or more mode apertures defined therein. The first plate having a top surface and a bottom surface and having a plurality of first channel walls extending from the top surface. The second plate is connected to the first plate and includes a top surface and a bottom surface and a plurality of second channel walls extending from the bottom surface. The first channel walls of the first plate engage the second channel walls of the second plate to define a plurality of chambers and each of the plurality of chambers is fluid communication with one of the two or more mode apertures defined in the manifold. The a radial mode changer is positioned in the manifold and is in fluid communication with a water inlet. The radial mode changer includes one or more ports in selective fluid communication with the two or more mode aperture. Rotation of the radial mode changer within the manifold selectively varies water flow through the plurality of chambers.

In yet another embodiment, a radial mode engine is provided for expelling water using a plurality of spray modes. The radial mode engine includes a front channel plate having a manifold formed by an annular wall with a number of mode apertures defined in the annular wall. A number of partitions extend from an exterior of the annular wall and define at least two channels, which each correspond to one of the plurality of spray modes. The mode apertures provide fluid communication between the manifold and the at least two channels, and the channels provide a water outflow of the corresponding spray mode. A rear channel plate couples to the front channel plate and encloses the at least two channels to form at least two chambers. A radial mode changer is received in the annular wall and is formed as cylindrical body, which defines a hollow passageway in fluid communication with a water inflow and defines one or more recessed ports in fluid communication with the hollow passageway. When the radial mode changer is rotated relative to the manifold to align one of the recessed ports with one of the mode apertures, water from the water inflow flows through the radial mode changer into one of the chambers to provide water outflow of the corresponding mode. When the radial mode changer is again rotated relative to the manifold, the one or more of the recessed ports aligns with two of the mode apertures such that water from the water inflow flows through the radial mode changer into two of the chambers to provide water outflow of the two corresponding modes.

These and other features and advantages of the present disclosure will become apparent to those skilled in the art from the following detailed description, wherein it is shown and described illustrative implementations, including best modes contemplated. As it will be realized, modifications in various obvious aspects may be made, all without departing from the spirit and scope of the present disclosure. Accordingly, the drawings and detailed description are to be regarded as illustrative in nature and not restrictive.

DETAILED DESCRIPTION

A spray controller for providing several different spray modes of standard sprays and pulsed sprays, alone or in combination, to a shower assembly, e.g., a showerhead, a shower bracket for a hand shower, a diverter valve, a shower arm, or other shower combinations, is provided. Various aspects of this technology are described below with reference to the accompanying figures.

Figure 1:
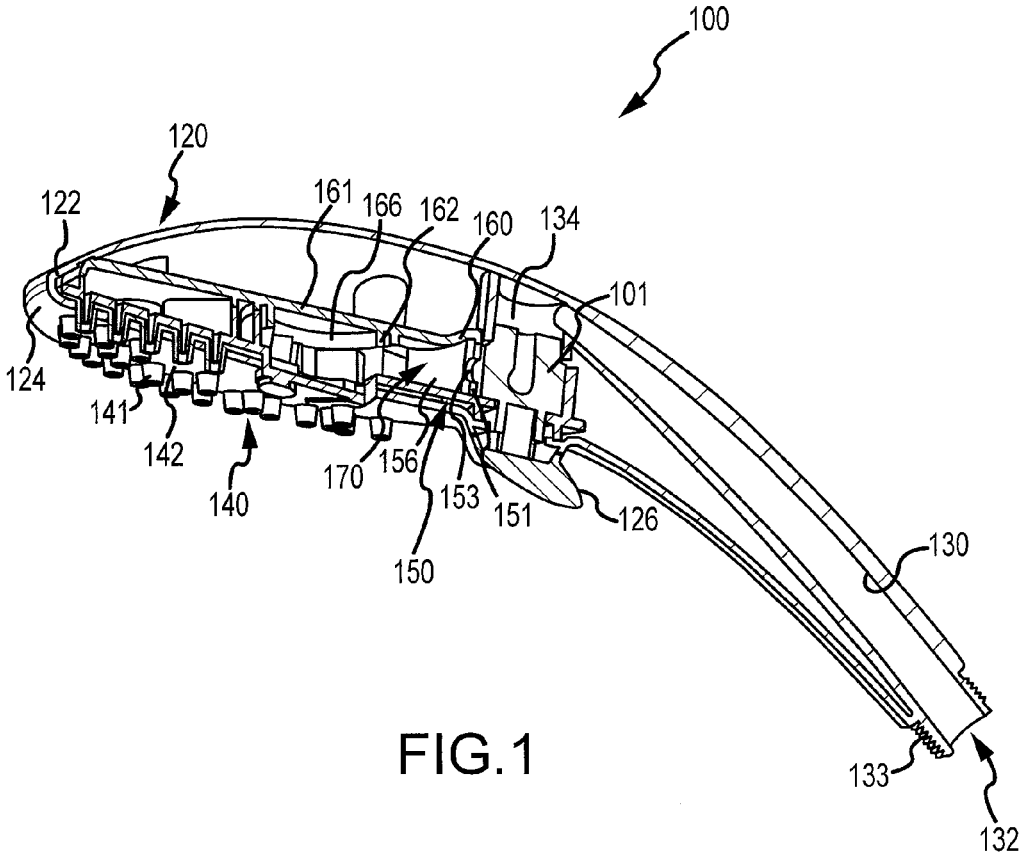
FIG. 1 provides an isometric, cross-sectional view of an exemplary shower assembly according to certain embodiments.

FIG. 1 depicts an isometric cross-sectional view of a shower assembly 100 that includes radial mode changer 101 for providing spray control. Shower assembly 100, in addition to radial mode changer 101, includes housing 120 with water inflow 130 for receiving water from a water source, water outflow 140, front channel plate 150, rear channel plate 160, and chambers 170 defined by the interior wall of front and rear channel plates 150, 160.

According to certain embodiments, radial mode changer 101 may be an arrangement of two concentric cylinders with an inner cylinder defining an opening at a top, which is connected to the water inlet for receiving water from a water source via water inflow 130. Two seals of different sizes defining recessed ports may be funnel shaped and widen from the opening defined in the cylinder and terminate at a side of the cylinder. The fluid passageway defined through the top and side of the concentric cylinders results in water received in the inner cylinder being redirected transverse from the direction the water was received. The water stream entering radial mode changer 101 may optionally be split into two or more paths via the seals, which deliver the stream or streams of water to water outflow 140, where the water exits the shower assembly via one or more spray modes determined by the configuration of interior chamber 170 and the mode selected by a user operating radial mode changer 101.

Housing 120 is configured to enclose radial mode changer 101, and may include an exterior with top surface 122 and bottom surface 124. According to certain implementations, mode changer knob 126 may extend from the external bottom surface 124 of housing 120 and couple to radial mode changer 101, such that rotation of knob 126 slaves and effects rotation of radial mode changer 101, and causes radial mode changer 101 to move among and between one or more spray modes. Operating radial mode changer 101 may thus be simplified because, for example, rotation of changer knob 126 coupled to a radial mode changer 101 is used to effect mode change as opposed to rotation of a component surrounding the entire circumference of the showerhead.

Water inflow 130, for delivering water to radial mode changer 101, may be configured as handle 131 with a hollow tubular interior formed by housing 120. Handle 131 may be coupled to a water source (not shown) by a threaded engagement via threading 132 at receiving end 133 of handle 131. Water inflow 130 may terminate proximate inflow passageway 134, e.g., at or in inflow passageway 134, defined by a cylindrical wall sized and shaped to complement or couple to a top portion of radial mode changer 101. According to the embodiment depicted in FIG. 1, inflow passageway 134 extends axially relative to radial mode changer 101, and inflow passageway 134 is configured as a tubular member that may be sealingly coupled around the exterior walls of radial mode changer 101. The cylindrical walls of inflow passageway 134 may at least partially, and closely, receive a top portion of radial mode changer 101. Configurations of water inflow 130 other than a handle may include conduits leading to inflow passageways formed by showerheads, shower brackets for hand showers, diverter valves, and other showerhead combinations, which may complement or may be configured to feed into the radial mode changer 101.

Water outflow 140 is an arrangement of a series of spray nozzles from which water exits the shower assembly 100. As water exits radial mode changer 101 and passes through front channel plate 150 and rear channel plate 160, the water is delivered from shower assembly 100 via water outflow 140. Water outflow 140 may include nozzles 141 and apertures 142 extending below bottom surface 124 of housing 120. According to certain implementations, nozzles 141 and apertures 142 may be associated with or integral to front channel plate 150.

According to FIG. 1, front channel plate 150 may be configured with manifold 151 arranged between water inflow 130 and water outflow 140, so that manifold 151 is arranged behind an area from which water exits the shower assembly 100. That is, manifold 151 is positioned at a first end of front channel plate 150, while the channels defined by partitions 156 extend or radiate from an outer wall of manifold 151 towards a second end of the front channel plate 150. Manifold 151 is cylindrically sized and shaped such that cylindrical radial mode changer 101 may be at least partially seated in an interior or a cavity of manifold 151. Manifold 151 may include an annular wall extending from a top surface of the front channel plate 150 arranged axially relative to radial mode changer 101. A tubular cavity defined by the annular wall of manifold 151 includes mode apertures 152, 153, and 154 (see FIGS. 3A, 3F, 5A-5C, and 6A-6H) defined by vertically-oriented, annular-shaped walls forming openings arranged in the annular wall of manifold 151. Water exiting radial mode changer 101 passes through one or more mode apertures 152, 153, and 154 (each corresponding to an independent spray mode), into channels defined by sidewalls or partitions 156 in order to deliver water to the water outflow 140.

Rear channel plate 160, according to FIG. 1, includes a first surface 161 for affixing to housing 120 of shower assembly 100, and a second surface 162 configured with a number of vertically arranged sidewalls or partitions 166 sized and shaped to couple with sidewalls or partitions 156 from front channel plate 150 to form continuous chamber walls.

Accordingly, one or more chambers 170 may be formed by coupling sidewalls or partitions 156, 166 of front channel plate 150 and rear channel plate 160. Chambers 170 may be sealed with respect to one another and receive water flow from radial mode changer 101. As water flows into one or more sealed chambers 170, the water is forced through the flow paths formed by the chambers, and exits the output apertures and nozzles configured for a desired spray mode. It will be understood that chambers 170 may be formed by walls of the front and/or rear channel plate 150, 160 and may include sealing structures, for example O-rings, polymeric seals, portions of the channel plate that mate with another channel plate or other structure that include complementary protruding and recessed structures, or recessed structures configured to receive O-rings or polymeric seals, so as to provide a seal between multiple chambers 170 and between the chambers 170 and other portions of shower assembly 100.

FIGS. 2A-2F provide an isometric view, a bottom plan view, a first side elevation view, a second side elevation view, a vertical cross-section view (taken along line 2E-2E in FIG. 2D) and a horizontal cross-section view (taken along line 2F-2F in FIG. 2D), respectively, of the radial mode changer 101, according to certain embodiments.

According to FIGS. 2A-2F, radial mode changer 101 is configured as a generally cylindrical structure of two concentric cylinders, and includes top recessed portion 102 and bottom recessed portion 104 together forming an inner cylinder, which is separated by body portion 106 forming an outer cylinder. First open end 108 defines an entrance to first hollow passageway 110 through the top recessed portion 102 of the inner cylinder and second open end 111 defines an entrance to second hollow passageway 112 (FIG. 2B) through the bottom recessed portion 104, a first recessed port 113 and second recessed port 114 (FIG. 2F) defined in the body portion 106 and fluidly coupled to first hollow passageway 110, cut-out 115 defined in the body portion 106, and slot 116 defined in the bottom recessed portion 104.

Figure 3A:
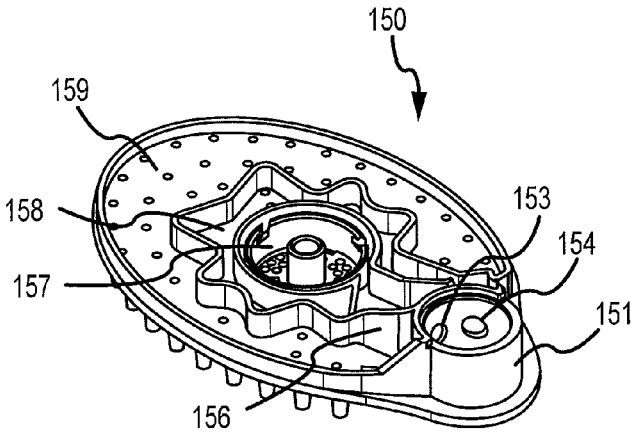
FIGS. 3A-E depict an isometric view, a top plan view, a right side elevation view, a bottom plan view, and a vertical cross-sectional view as indicated in FIG. 3D, respectively, of a front channel plate provided according to certain embodiments.
Figure 3B:
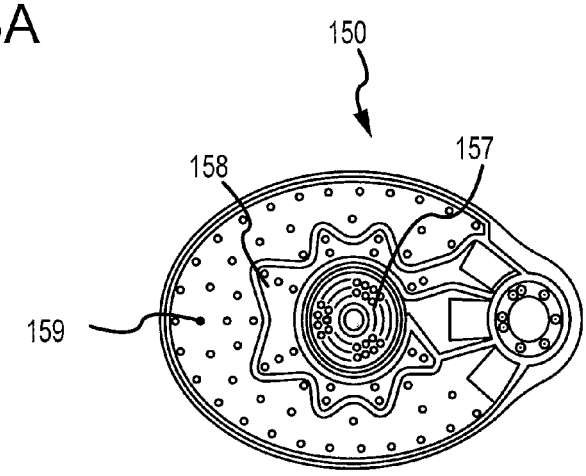
Figure 3C:
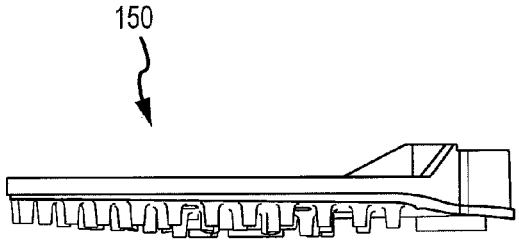
Figure 3D:
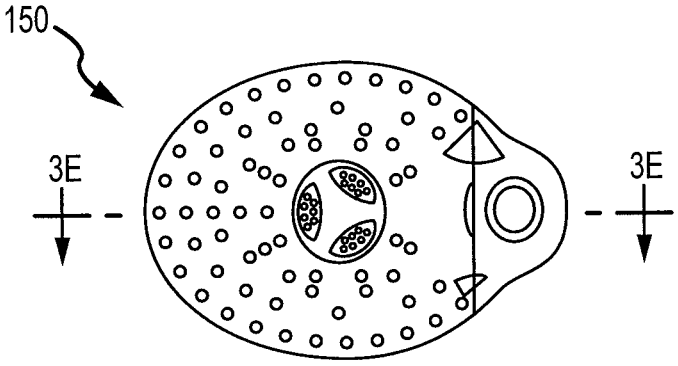
Figure 3E:
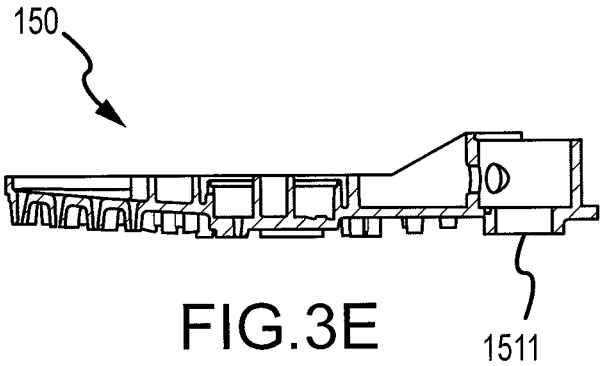

The top recessed portion 102, bottom recessed portion 104, and body portion 106 of radial mode changer 101 may be configured so that each portion may sit in or receive a component of shower assembly 100. According to certain implementations, the body portion 106 is assembled in manifold 151. Such an arrangement provides for the outer wall of body portion 106 to sealingly engage with the inner wall of manifold 151. In this arrangement, at least a portion of top recessed portion 102 extends beyond the annular walls of manifold 151 for receiving inflow passageway 134. Bottom recessed portion 104 may be sized and shaped to extend through and out of front channel plate 150 at an opening 1511 (see FIG. 3E) defined by manifold 151 for receiving a control knob 126. It will be understood that one or more portions of radial mode changer 101 in addition to body portion 106 may also sealingly engage with the various components of the shower assembly 100.

First open end 108 at top recessed portion 102 may also extend above manifold 151. In this configuration, top recessed portion 102, at or near first open end 108, may include one or more sections that are recessed radially such that one or more annular ridges 117 (see FIG. 2D) extend circumferentially about the top recessed portion 102. The annular ridges 117 may be configured to accommodate an O-ring 200 (see FIG. 2J) or a lip seal 201 with V-shaped annular groove 202 (see FIG. 2E) between annular ridges 117. This allows the top recessed portion 102 to sealingly couple to inflow passageway 134.

First hollow passageway 110 arranged at first open end 108 is formed in an inner cylinder of the two concentric cylinders and extends axially into the body portion 106. First hollow passageway 110 is configured to receive water from inflow passageway 134 and to be fluidly coupled to recessed ports 113, 114 defined in the body portion 106. The interconnection between first hollow passageway 110 and recessed ports 113, 114 fluidly couples water inflow 130 to water outflow 140.

Second open end 111 defines an entrance to second hollow passageway 112, which extends axially into bottom recessed portion 104, but terminates before meeting first hollow passageway 110. The second open end 111 extends out of the front channel plate 150 via the opening 1511 defined by manifold 151. By way of slot 116, the second open end 111 may engagingly couple with a mode changer knob 126 (see FIGS. 1 and 5D) extending from the external bottom surface 124 of the housing 120. Accordingly, rotation of the knob 126 effects rotation of the radial mode changer 101 and causes the radial mode changer 101 move among and between one or more spray modes. In order to provide a sealing engagement between bottom recessed portion and the opening 1511, a lip seal 204 (see FIG. 2J) may be provided around a circumference of the bottom recessed portion 104 where manifold 151 receives the bottom recessed portion 104. The arrangement of lip seal 204 adjacent to the second open end may prevent water from entering the shower assembly from the area of the knob 126.

Figure 2A:
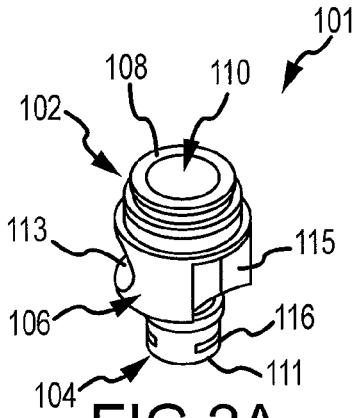
FIGS. 2A-F depict an isometric view, a bottom plan view, a first side elevation view, a second side elevation view, and vertical and horizontal cross-sectional views as indicated in FIG. 2D, respectively, of an embodiment of the radial mode changer provided according to certain implementations.
Figure 2B:
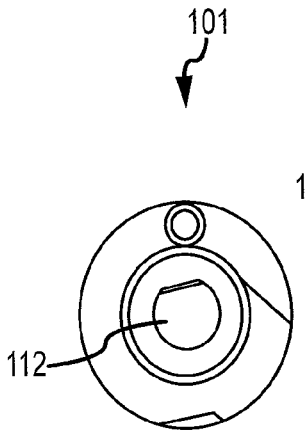
Figure 2C:
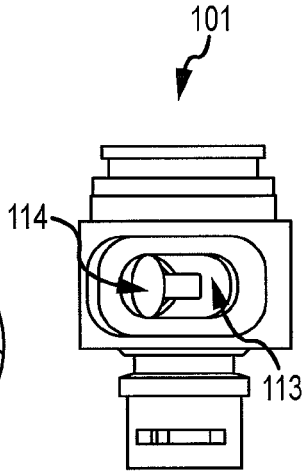
Figure 2D:
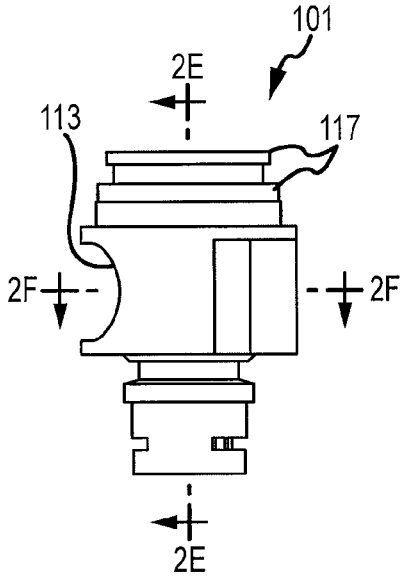
Figure 2E:
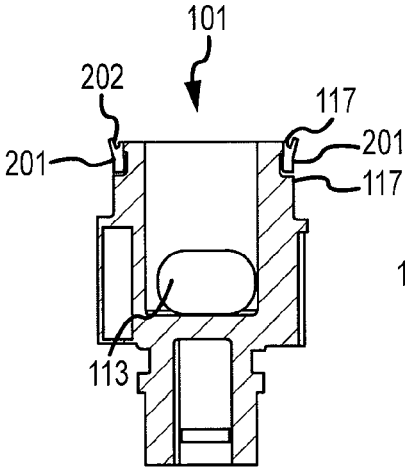
Figure 2F:
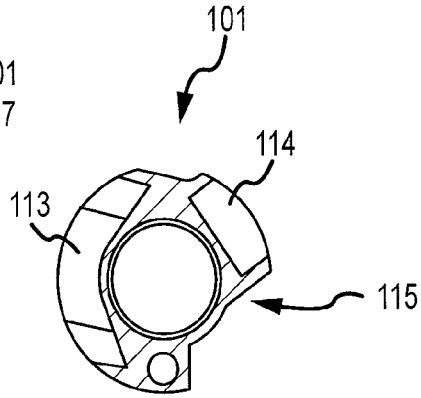

In some embodiments, recessed ports 113, 114 may be formed in the body portion 106 as a cut-out or concave portion defined by walls the body portion 106 and may be radially recessed up to the first hollow passageway 110. Recessed ports 113, 114 may extend axially along all or a portion of the length of the main body portion 106, and may extend longitudinally around a portion of the circumference of the main body portion 106. In certain implementations, first recessed port 113 may extend around the circumference of the body portion 106 a distance greater or less than the distance in which second recessed port 114 extends around the body portion 106. As illustrated in FIG. 2F, first recessed port 113 extends around the circumference of body portion 106 a greater distance than second recessed port 114. In another embodiment, first and second recessed ports 113, 114 may extend circumferentially about the body portion 106 about the same distance. Referring to FIG. 2C, first and second recessed ports 113, 114 may be elliptical. First and second recessed ports 113, 114 may be configured with a shape for facilitating delivery of water to chambers 170. For example, the fluid path between first hollow passageway 110 and first and second recessed ports 113, 114 may expand as it travels radially outward such that the path is generally funnel-shaped. This funnel shape may facilitate directing the water to the apertures in manifold 151. In certain implementations, a number of recessed ports, such as three or more recessed ports, may be defined in body portion 106. According to further embodiments, and as described in the embodiments below, recessed ports may include sealing components to form one or more tightly fitted fluid connections between the radial mode changer and the manifold 151.

Figure 2G:
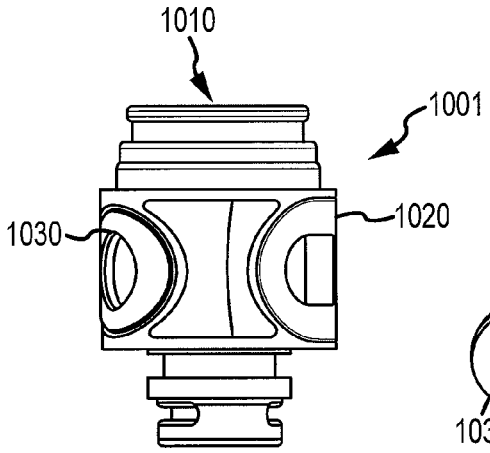
FIGS. 2G-I depict a isometric views, with FIGS. 2H and 2I being exploded views, of another embodiment of a radial mode changer according to alternative implementations.
Figure 2H:
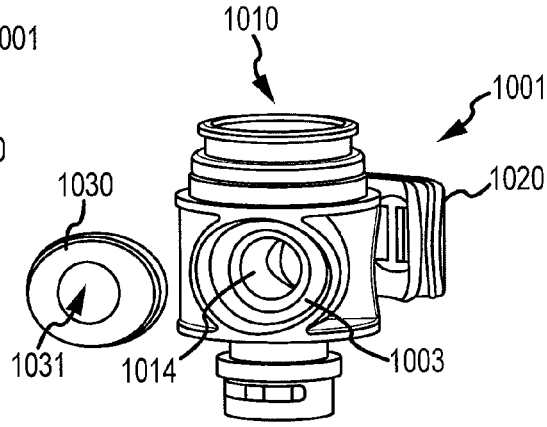
Figure 2I:
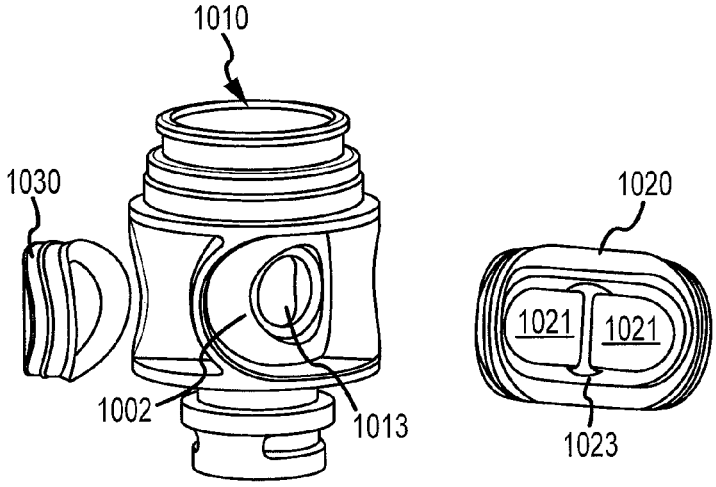
Figure 2J:
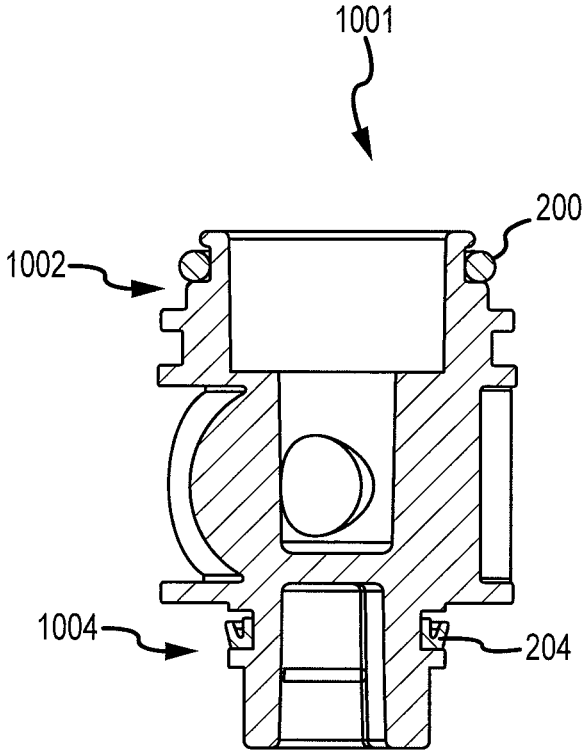
FIG. 2J depicts a cross-section view of a radial mode changer according to a further alternative implementation.

FIGS. 2G-I depict several isometric views of another embodiment of a radial mode changer 1001, which provide sealing features between the radial mode changer 1001 and the shower assembly. According to FIGS. 2G-I, radial mode changer 1001 includes a first seal cup 1020 and a second seal cup 1030 received, respectively, in a first concave recessed port 1002 and a second concave recessed port 1003 of radial mode changer 1001. In some embodiments, the first and second seal cups 1020, 1030 may have sides and rear faces sized and shaped to be sealingly accommodated in first recessed port 1002 and second recessed port 1003 surrounding annular openings 1013, 1014 formed in hollow passageway 1010 for providing a fluid connection to the seal cups 1020, 1030 from hollow passageway 1010. A front face may be sized and shaped to sealingly fit in manifold 151 when radial mode changer 1001 is arranged in a shower assembly.

Seal cups 1020, 1030 may include an exit aperture configured to serve as a water conduit between the body of radial mode changer 1001 and one manifold mode aperture, e.g., mode aperture 152, 153, or 154 (See FIGS. 3A-3F and FIGS. 6A-6H). Accordingly, the seal cups 1020, 1030 may be sized and shaped to complement the size and shape of the mode aperture. For example, in FIGS. 2G-I, seal cup 1030 defines exit aperture 1031, which serves to deliver water from the radial mode changer 1001 to one mode aperture, and is sized and shaped to feed directly to a single mode aperture. Where the seal cup is configured to serve as a conduit between the body of radial mode changer 1001 and one or more mode apertures, e.g., mode aperture 152, 153, or 154, or mode apertures 152 and 153, or 152 and 154, or 153 and 154, or 152, 153 and 154, the seal cup exit aperture may define an elongate opening and be supported by a rib so that the aperture feeds to one or multiple mode apertures. Thus, for example, as shown in FIGS. 2G-I, seal cup 1020 defines exit aperture 1021 separated by a vertical rib 1023 to provide support to the seal cup 1020. Exit apertures 1021, 1031 may generally funnel-shaped for facilitating directing water to the apertures in manifold 151.

In certain implementations, apertures may be arranged about the perimeter of radial mode changer 1001 at the same height, while in other implementations, apertures may be staggered vertically around the perimeter of radial mode changer 1001. In addition, one, two, three, four or more exit apertures 1021, 1031 may be defined in the outer surfaces of the first and second seal cups 1020, 1030. As will be discussed in greater detail below, exit aperture 1021 and/or exit aperture 1031 are fluidly connected to hollow passageway 1010 and may be utilized simultaneously or individually to deliver water to the water outflow 140.

In addition, first and second seal cups 1020, 1030 may be used to form a water-tight seal between the radial mode changer 1001 and an inner wall of the manifold 151 such that water may be expelled from radial mode changer 1001 when one or more mode apertures 152, 153, 154 is at least partially aligned with one or more exit apertures 1021, 1031. Generally, seal cups 1020, 1030 may be formed from a pliable, non-porous material, such as for example, rubber or plastic.

According to certain embodiments, radial mode changer 101/1001 may include a first open end defining an entrance to first hollow passageway 110/1010 for enabling water to flow from water inflow 130 into sealed chambers 170 via the mode changer 101/1001. In this regard, in certain embodiments, water may flow into the radial mode changer 101/1001 in a direction that is transverse to the direction in which water is expelled from radial mode changer 101/1001. For example, as shown in FIG. 1, water may flow into radial mode changer 101 axially, e.g., vertically, and may flow out of radial mode changer 101 radially, e.g., horizontally, relative to the rotational axis of the radial mode changer. Additionally, in some implementations, water may be expelled from radial mode changer 101/1001 in a direction that is transverse to the direction in which water is expelled from the shower assembly 100 water outflow 140. For example, as shown in FIG. 1, water may be expelled from the mode changer 101 substantially horizontally, and may exit the shower assembly 100 vertically. Alternatively, the direction water is expelled from the radial mode changer 101 may be at a desired angle relative to the direction in which water is expelled from the shower assembly 100.

Figure 3F:
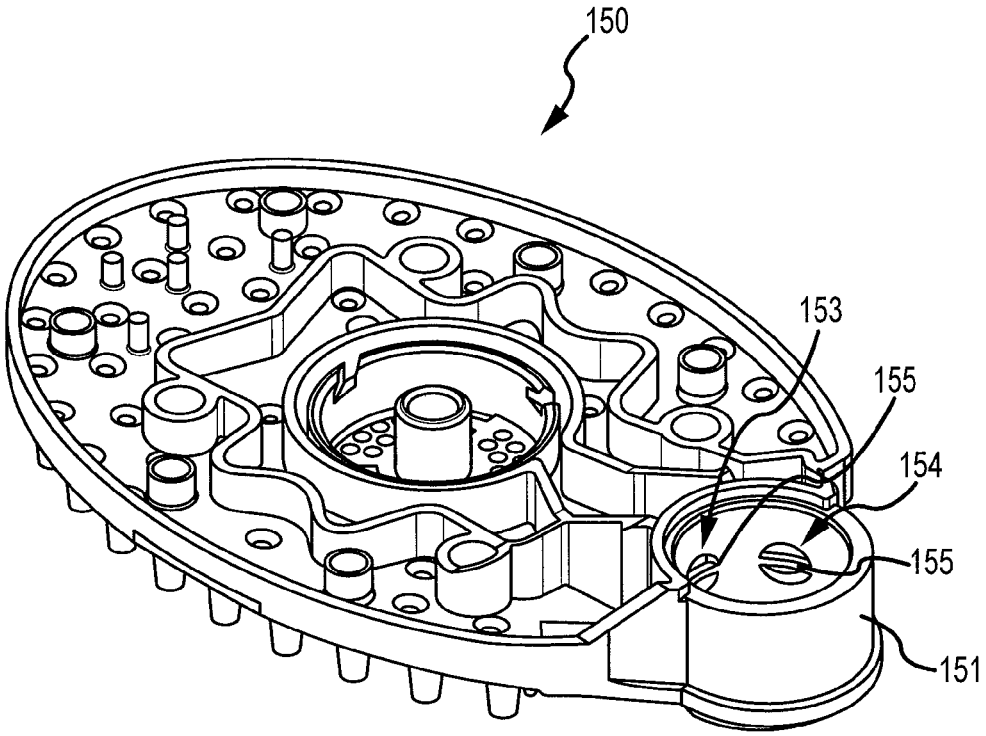
FIG. 3F depicts an isometric view of another front channel plate provided according to certain embodiments.

Radial mode changer 101/1001 may be fabricated using any suitable manufacturing methods including: molding, over-molding, injection molding, reaction injection molding, machining, pressing and punching. Additionally, radial mode changer 101/1001 may be constructed of materials including metal, plastic, rubber, or combinations and variations thereof FIGS. 3A-3E provide isometric, top, side, bottom and horizontal cross-sectional (along line 3E-3E in FIG. 3D) views, respectively, of front channel plate 150, according to some embodiments, with radial mode changer 101 having been removed from the manifold 151. Front channel plate 150 may have an elliptical outer profile such as illustrated in FIGS. 3A-3D. Alternatively, front channel plate 150 may be configured with a circular, rectangular, polygonal, or other suitable shape. Manifold 151 includes port holes configured as mode apertures 152 (see FIG.), 153 and 154. According to some implementations, mode apertures may be aligned horizontally or may be staggered vertically around manifold 151. In addition, although mode apertures are depicted as annular openings, mode apertures may be formed into a variety of shapes, e.g., oval shaped, a narrow band, a grouping of openings associated with one channel, and each aperture may be of a different type or shape from the other. FIG. 3F illustrates horizontal ribs 155 extending across each mode aperture for providing support to cup seals 1020, 1030 as the radial mode changer 1001 rotates through the modes in order to prevent cross mode leakage.

Returning to FIGS. 3A-3B, the top surface of the front channel plate 150 may form a plurality of channels formed by partitions 156 to direct water received from three mode apertures 152, 153 and 154, via radial mode changer 101, to the appropriate spray mode apertures as selected by a user. Channels 157, 158 and 159 may be defined by walls or partitions 156 extending from the top side of the front channel plate 150. As will be described below, complementary walls extending from the bottom side of rear channel plate 160 may sealingly mate with the walls of front channel plate 150 to form chambers 170.

According to certain embodiments, a first, innermost channel 157 may be circular in shape and define a portion of the pulsating spray chamber. A second, middle channel 158 may concentrically surround a majority of first channel 157 and at least partially define a hard spray chamber. A plurality of hard spray apertures may be formed in second channel 158, each hard spray aperture having a similar diameter. Flow from radial mode changer 101 may be expelled into the second channel 158 to actuate the hard spray mode. A third, outermost channel 159 may concentrically surround a majority of second channel 158 and at least partially define an outer spray chamber. A plurality of outer spray apertures may be formed in third channel 159, each outer spray aperture having a similar diameter. Flow from radial mode changer 101 may be expelled into third channel 158 to actuate the outer spray mode.

While the present disclosure describes three concentrically arranged channels having a number of outlet apertures formed therein, it should be appreciated that a number of channels having various orientations and numbers of outlet apertures may be employed without deviating from the scope of the present disclosure.

FIGS. 4A-4E provide isometric, top plan, side elevation, bottom plan and vertical cross-sectional (taken along line 4E-4E in FIG. 4D) views, respectively, of rear channel plate 160, according to certain embodiments. Rear channel plate 160 may have a shape that is generally complementary to the shape of the front channel plate 150, i.e., the front channel plate 150 and the rear channel plate 160 have the same or similar circumferential shape. On a top surface 161 of the rear channel plate 160, a plurality of spaced attachment protrusions 167 may extend in the direction of the housing 120, when assembled. Attachment protrusions 167 may mate with complementary members of the housing 120 to stabilize the assembly of the front channel plate 150 and rear channel plate 160 within the interior of the shower assembly 100. In addition, one or more snaps 163 (see FIG. 4F) may be provided at a recessed portion 169 of a ramped region 168 to provide a flexible snap connection for mating rear channel plate 160 with the shower assembly housing 120, for example.

Figure 4A:
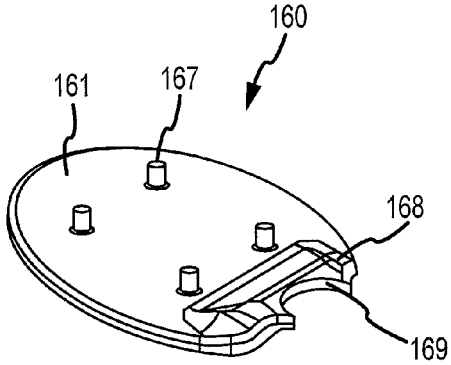
FIGS. 4A-E depict an isometric view, a top plan view, a left side elevation view, a bottom plan view, and a vertical cross-sectional view as indicated in FIG. 4D, respectively, of a rear channel plate provided according to certain embodiments.
Figure 4B:
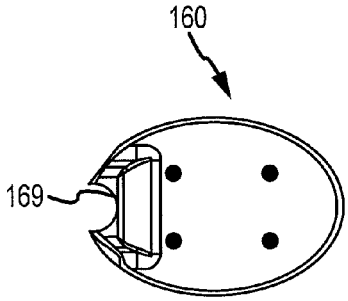
Figure 4C:
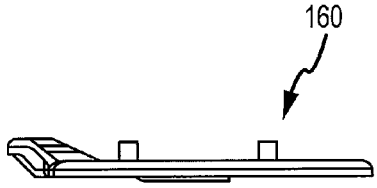
Figure 4D:
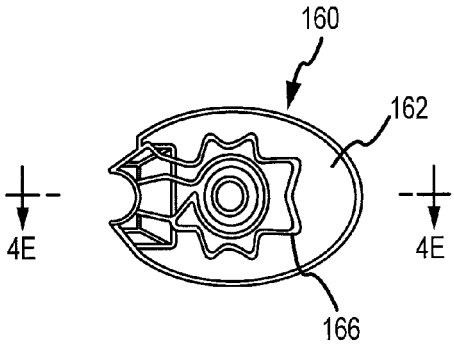
Figure 4E:
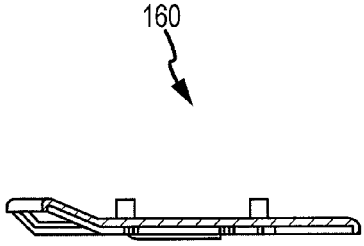
Figure 4F:
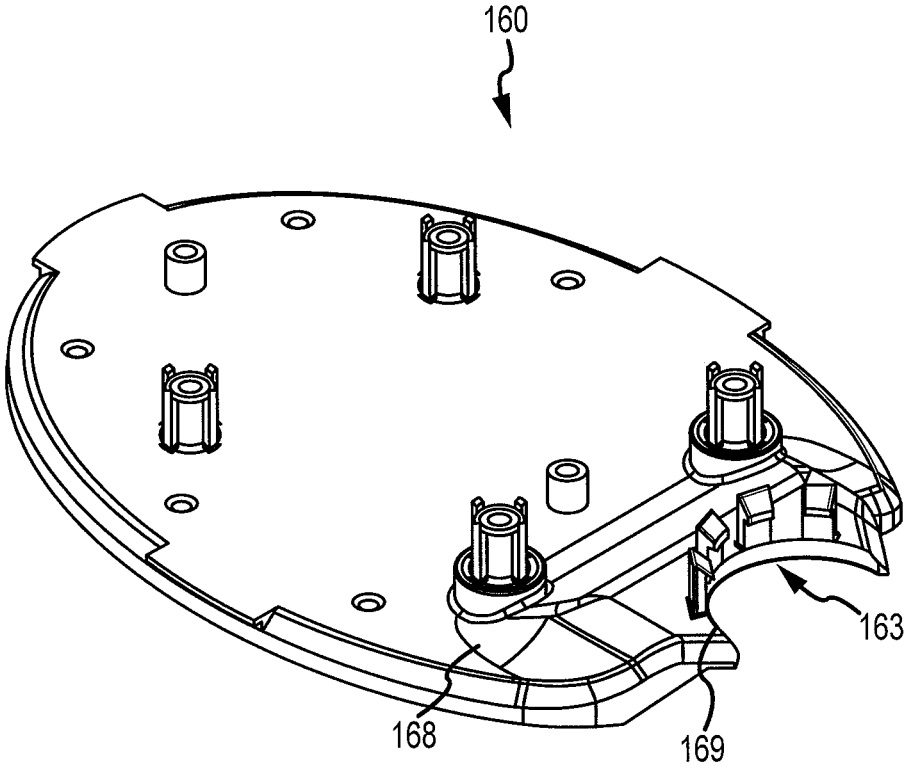
FIG. 4F depicts an isometric view of another rear channel plate provided according to certain embodiments.

With respect to FIG. 4D, a bottom view of the rear channel plate 160 is shown and as previously discussed, second surface 162 of rear channel plate 160 may be configured with a number of vertically arranged partitions 166 sized and shaped to be complementary with partitions 156 from front channel plate 150. Accordingly, partitions 166 may protrude from the second surface 162 to define channel walls corresponding to the channel walls provided in front channel plate 150. In the assembled shower assembly 100, the partitions 166 of the rear channel plate 160 sealingly mate with the partitions 156 of the front channel plate 150 to form chambers 170, which are sealed with respect to one another.

A ramped region 168 with a recessed portion 169 may be provided in a portion of the periphery of the rear channel plate 160. The ramped region 168 may correspond with a portion of the front channel plate 150 adjacent to manifold 151 in the area of the mode apertures 152, 153 and 154. In the assembled shower assembly, the recessed portion 169 may leave radial mode changer 101 exposed in order to enable radial mode changer 101 to form a seal with inflow passageway 134.

Figure 5A:
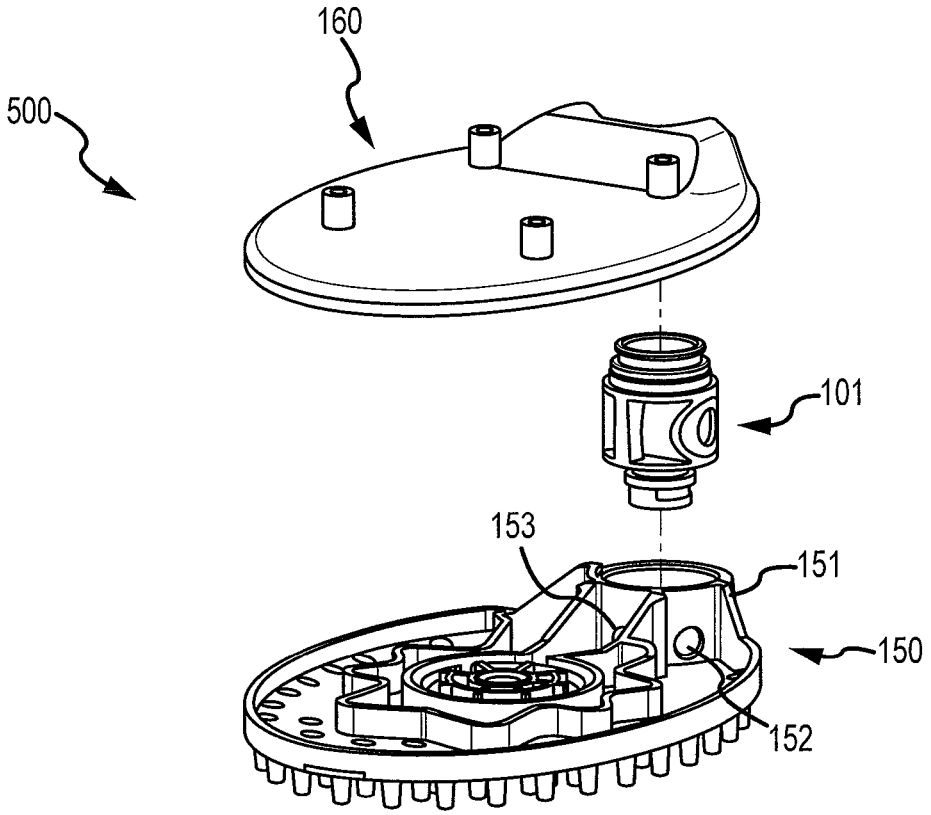
FIGS. 5A-B depict exploded isometric views of the radial mode changer and front and rear channel plates.
Figure 5B:
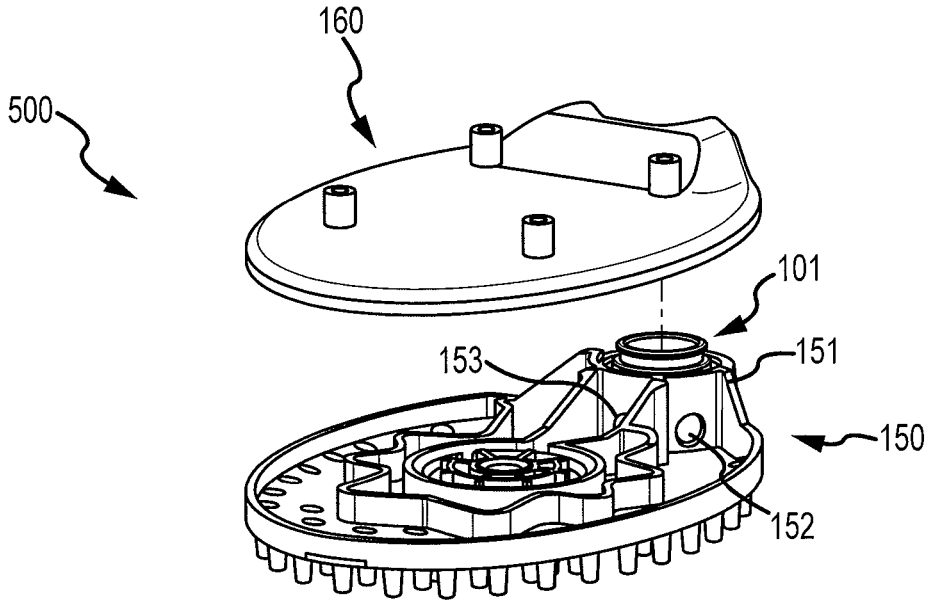

FIGS. 5A-B depict exploded isometric views of a radial mode engine 500 including a front channel plate 150, rear channel plate 160, and radial mode changer 101. Radial mode engine 500 provides a compartmentalized assembly enabling shower mode selection in an area behind the water outflow, and may be configured for use in a variety of shower assemblies, in addition to shower assembly 100. Radial mode engine may have a variety of configurations. For example, although front channel plate 150 in radial mode engine 500 provides manifold 151 and apertures 152, 153 and 154, it will be understood that portions of the manifold may be constructed from rear channel plate 160 or another structure configured to receive at least a portion of radial mode changer and to engage with the front and or rear channel plate. In addition, manifold 151 for seating radial mode changer 101, may be constructed separately from front and rear channel plate and may sealingly engage with portions of front and/or rear channel plate.

Figure 5C:
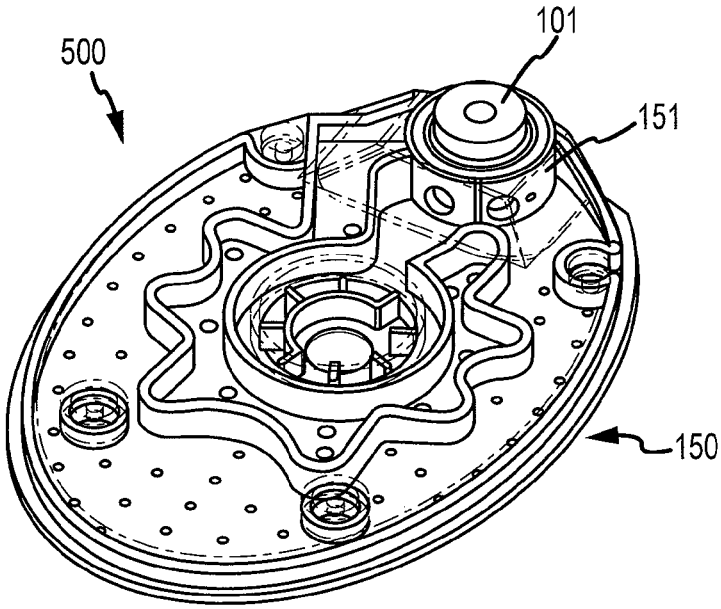
FIG. 5C depicts an isometric view of an assembly of a front channel plate, a radial mode changer, and a transparent rear channel plate.

FIG. 5C provides an isometric top side view of the radial mode changer 101 seated in manifold 151 in a perpendicular fashion relative to the direction of water spray. The manifold 151 may extend from a top surface of the front channel plate 150, be arranged axially relative to the orientation of the radial mode changer 101, and define a tubular cavity, which at least partially receives the mode changer 101. However, it will be understood that the manifold 151 and the radial mode changer 101 may be arranged at a desired angle relative to the direction of water spray, and as a result, the manifold 151 may extend from the top surface of the front channel plate at a right angle or at a desired angle.

A plurality of mode apertures 152, 153, 154 (see FIGS. 3A-3F and FIGS. 5A-5D) may be formed in a sidewall of the tubular recess of manifold 151 adjacent channels 157, 158, 159. Depending on the orientation of the mode changer 101 (i.e., the rotational position a user selects), the mode apertures 152, 153, 154 may align with one or more recessed ports 113, 114 or apertures of the mode changer 101 to actuate different spray modes. As will be described in more detail below, more than one spray mode may be actuated at a time. In one embodiment, manifold 151 may have a single mode aperture 152, 153, 154, which corresponds to each of the channels 157, 158, 159 that form chambers 170 due to rear channel plate 160 enclosing the channels to form the three chambers. That is, flow from one of the mode apertures 152, 153, 154 supplies flow to one of the three chambers associated with an independent spray mode, e.g., a hard spray, a pulse spray or an outer spray mode. Alternatively, a plurality of mode apertures may correspond to one or more of the chambers.

Figure 5D:
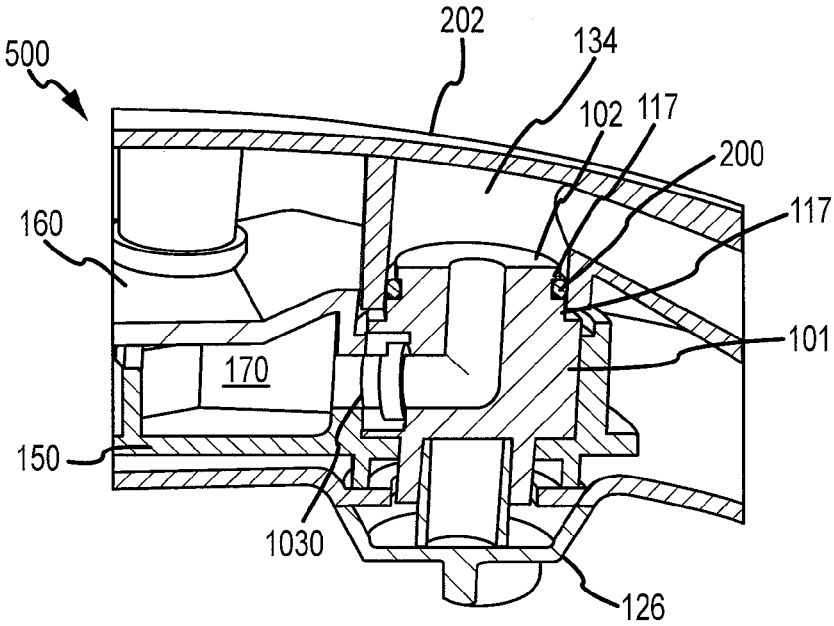
FIG. 5D is a detailed cross-sectional view of a radial mode changer arranged in a section of the interior of the channel plates and coupled to a knob at the exterior of the front channel plate.

As depicted in FIG. 5D, top recessed portion 102 of radial mode changer 101 may be sized and shaped relative to the inflow passageway 134 of water inflow 130, such that inflow passageway 134 may receive at least a portion of the top recessed portion 102. Thus, according to certain embodiments, a sealed connection may be established between the top recessed portion 102 and inflow passageway 134. In addition or alternatively, to establish a sealed connection between the inflow passageway 134 and mode changer 101, O-ring 200 may be seated between the annular ridges 117 such that when the mode changer 101 is received by the inflow passageway 134, at least a portion of the inflow passageway 134 sealingly abuts the O-ring 200. According to alternative implementations, the sealed connection between the inflow passageway 134 and top recessed portion 102 may be formed by a lip seal having a V-shaped annular groove formed in a top surface of the lip seal extending circumferentially.

With further reference to FIGS. 5C-D, when the radial mode changer 101 is assembled in manifold 151, an arrangement of three concentric cylinders is provided in which the outer cylinder of radial mode changer 101 forming body portion 106 is surrounded by an inner cylinder wall of manifold 151 at least along a portion of the height of body portion 106. Such an arrangement provides for the outer wall of body portion 106 to sealingly engage with the inner wall of manifold 151. In addition in FIG. 5D, radial mode changer further includes seal cup 1030, which also provides a sealing engagement between the radial mode changer 101 and the inner wall of manifold 151.

FIGS. 6A-H provide a top cross-sectional view of a portion of the front channel plate 150 and the radial mode changer 1001 seated in manifold 151. In some embodiments, radial mode changer 1001 may be positioned within the cavity of the manifold 151 such that the radial mode changer 1001 may rotate relative to the manifold 151. As shown, mode changer 1001 may define a plurality of flow paths for diverting flow to a desired spray mode upon rotation of radial mode changer 1001 for alignment of one or both flow paths 1110, 1210 with one more mode apertures 152, 153 and/or 154. Spray modes may be selected because first hollow passageway 1010 of mode changer 1001 terminates in flow paths 1110, 1210, each in fluid communication with at least one of the annular openings 1013, 1014 of the first and second recessed ports 1002, 1003. In this manner, flow from first hollow passageway 1010 may be channeled into one or more of the chambers 157, 158, 159.

As shown, a first flow path 1110 may provide flow through annular opening 1014 to seal cup 1030 accommodated in recessed port 1003 surrounding the annular opening 1014. Similarly, a second flow path 1210 may provide flow to annular opening 1013 so that water flows through seal cup 1020 accommodated in the recessed port 1002 surrounding the annular opening 1013. In FIGS. 6A-H, the outer surfaces of the seal cups 1020, 1030 may be contoured to seal against the inner wall of the manifold 151 such that water is expelled from the radial mode changer 1001 when one or more of the exit apertures 1021, 1031 are at least partially aligned with one or more of the mode apertures 152, 153, 154.

In an alternative embodiment, shower assembly 100 may be configured to secure radial mode changer 1001 against rotation. In this embodiment, for example, rotation of other components of the shower assembly 100, such as the housing 120 and/or manifold 151, may be rotatable relative to the radial mode changer 1001 in order to align mode apertures 152, 153, 154 with exit apertures 1021, 1031.

Figure 6A:
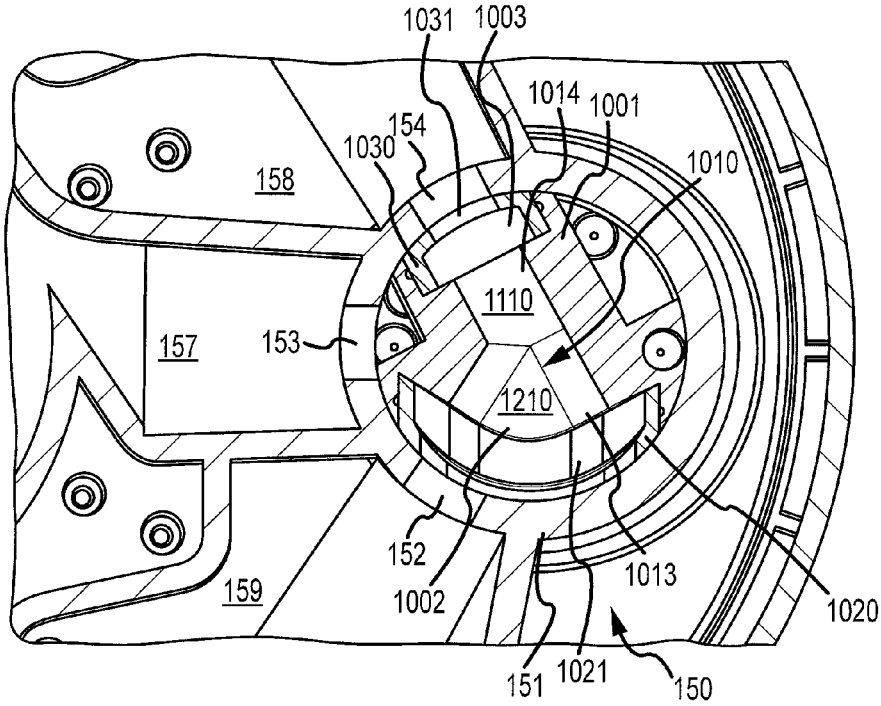
FIGS. 6A-H are a series of horizontal cross-sectional views of a radial mode changer arranged in a section of the front channel plate at various positions relative to the manifold of the front channel plate corresponding to different spray modes or combinations of spray modes.

FIGS. 6B-6H provide views similar to FIG. 6A, the radial mode changer 1001 having been rotated to various positions relative to the manifold 151 corresponding to seven different spray modes including three independent modes, three combination modes and a pause mode. The orientation of exit apertures 1021, 1031 may be configured such that flow at a given time may be provided to each spray mode individually, or any combination of two spray modes.

Figure 6B:
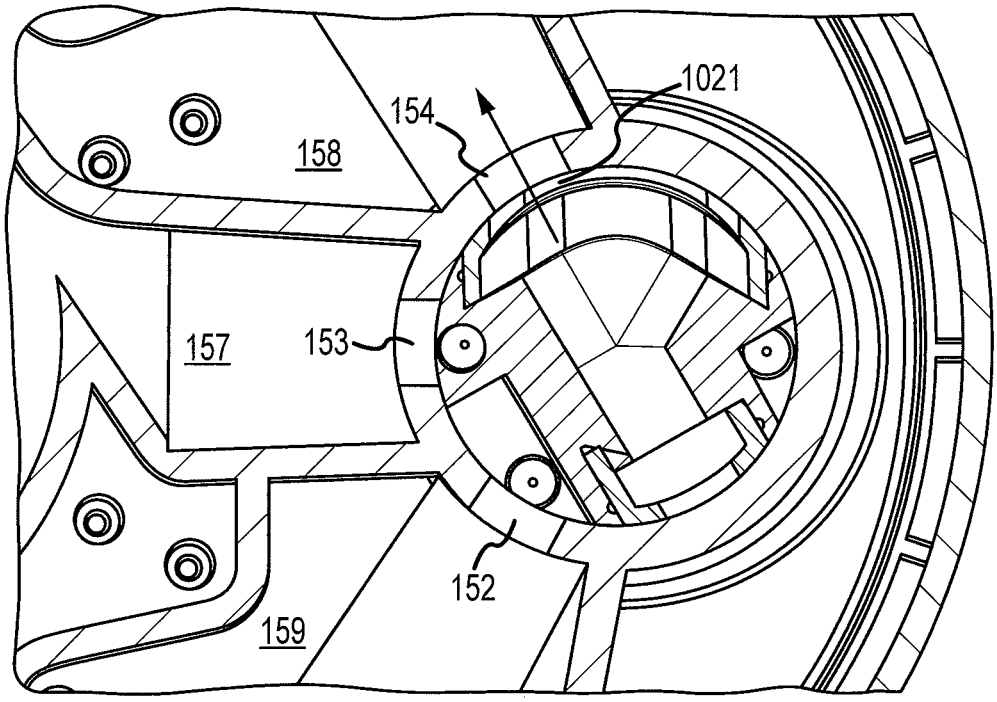

Referring to FIG. 6B, the radial mode changer 1001 has been rotated such that exit aperture 1021 is at least partially aligned with mode aperture 154, corresponding to the hard spray chamber 158. Thus, flow from the first hollow passageway 1010 may be directed to the hard spray chamber 158 and spray may emerge from the nozzles arranged in the hard spray chamber 158.

Figure 6C:
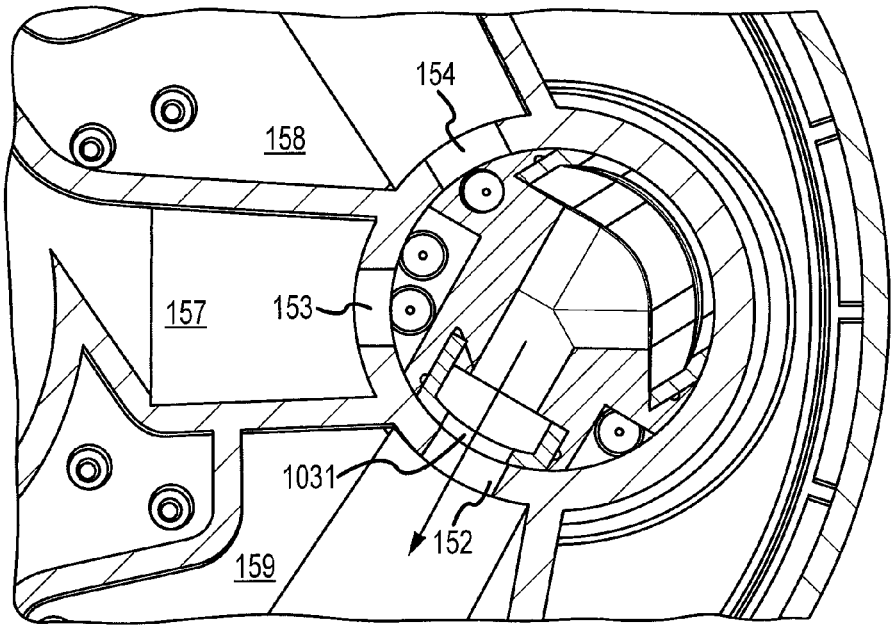

In FIG. 6C, the radial mode changer 1001 has been rotated for alignment of exit aperture 1031 with mode aperture 152 corresponding to the outer spray chamber 159. Thus, flow from the first hollow passageway 1010 may be directed to the outer spray chamber 159 and spray may emerge from the nozzles arranged on the outer area of the shower head in fluid connection with the outer spray chamber 159.

Figure 6D:
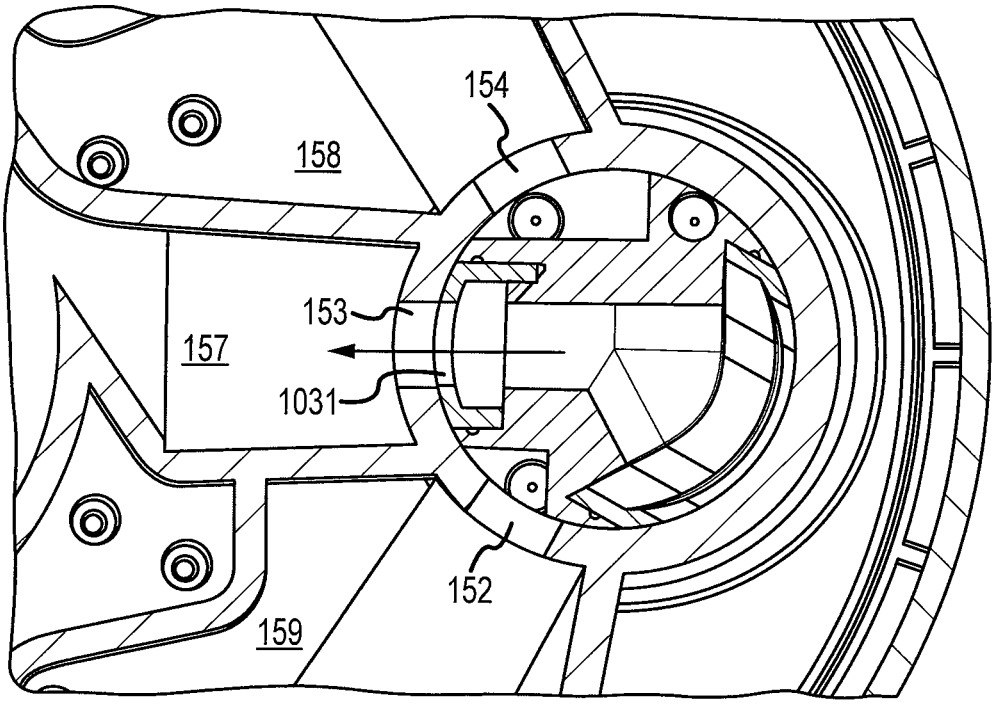

Referring to FIG. 6D, the radial mode changer 1001 is rotated for exit aperture 1031 to align with the mode aperture 153 corresponding to the pulse spray chamber 157. Thus, flow from the first hollow passageway 1010 may be directed to the pulse spray chamber 157 and pulsed spray may emerge from the apertures formed in the pulse spray chamber 157.

Figure 6E:
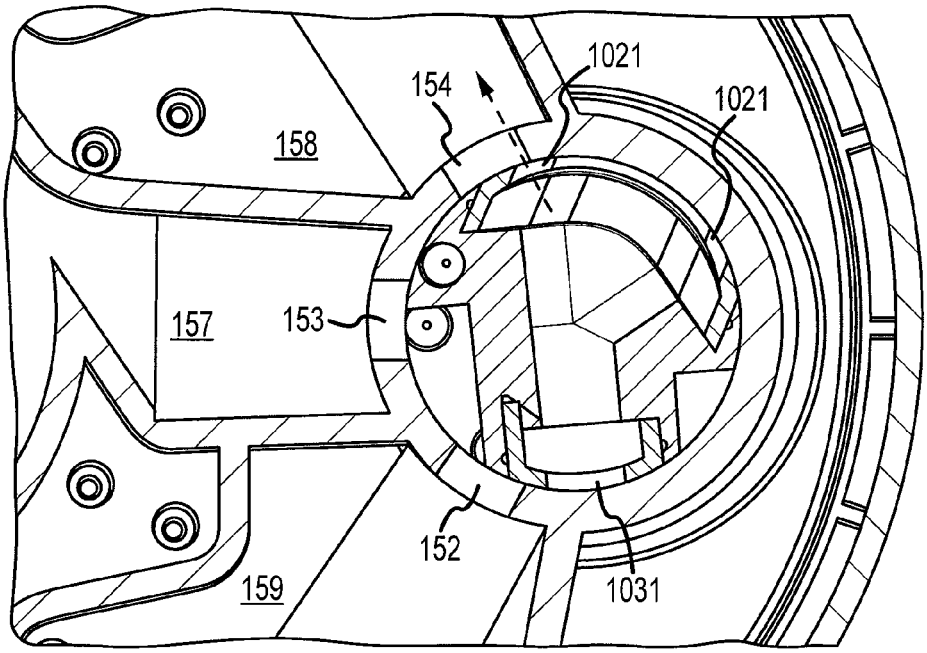

In some embodiments, radial mode changer 1001, and specifically, exit apertures 1021, 1031 may be configured such that one mode is always at least partially selected allowing for a reduced amount of flow from a spray chamber. Such a configuration aims to prevent "dead-heading" of water flow in the radial mode changer 1001. Referring to FIG. 6E, the radial mode changer 1001 has been rotated so the shower assembly 100 is in a pause spray mode. In one embodiment, in the pause spray mode, the exit aperture 1021 may be partially aligned with mode aperture 154. Alternatively, in the pause spray mode, either of the exit apertures 1021, 1031 may be partially aligned with any of the mode apertures 152, 153 and/or 154.

Figure 6F:
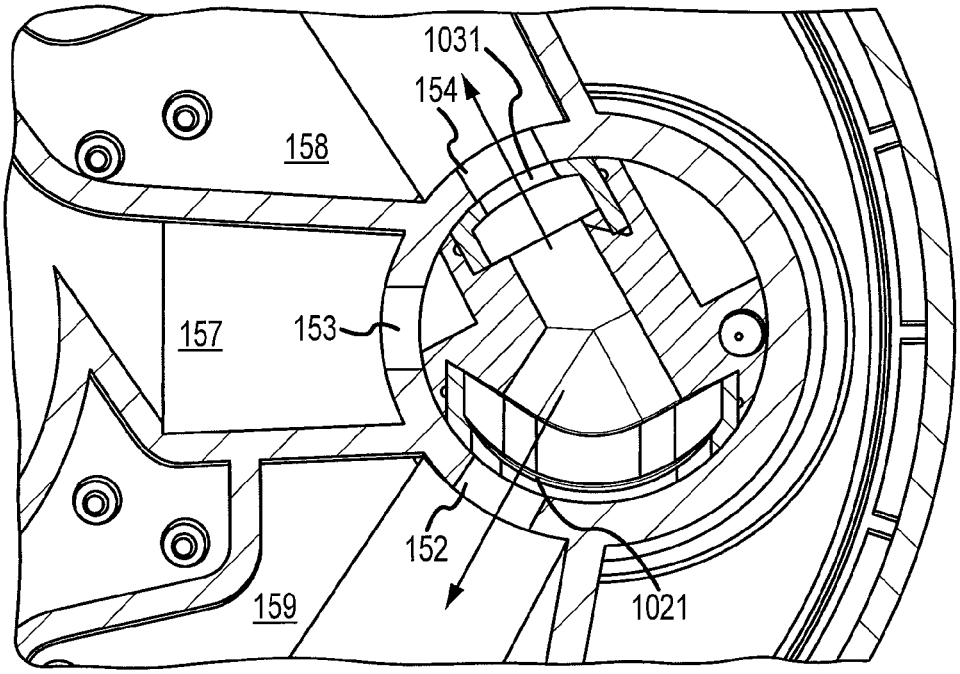

In some embodiments, radial mode changer 1001 may be configured so that flow at a given time may be provided to a combination of two or more spray modes. Referring to FIG. 6F, the radial mode changer 1001 has been rotated such that exit aperture 1021 is at least partially aligned with mode aperture 152, corresponding to the outer spray chamber 159, and exit aperture 1031 is at least partially aligned with mode aperture 154, corresponding to the hard spray chamber 158. Thus, flow from the first hollow passageway 1010 is split via mode changer 1001 into two paths and is directed to both of the outer spray chamber 159 and the hard spray chamber 158. In use, spray may thus emerge from the nozzles formed in the hard spray and outer spray chambers 158, 159.

Figure 6G:
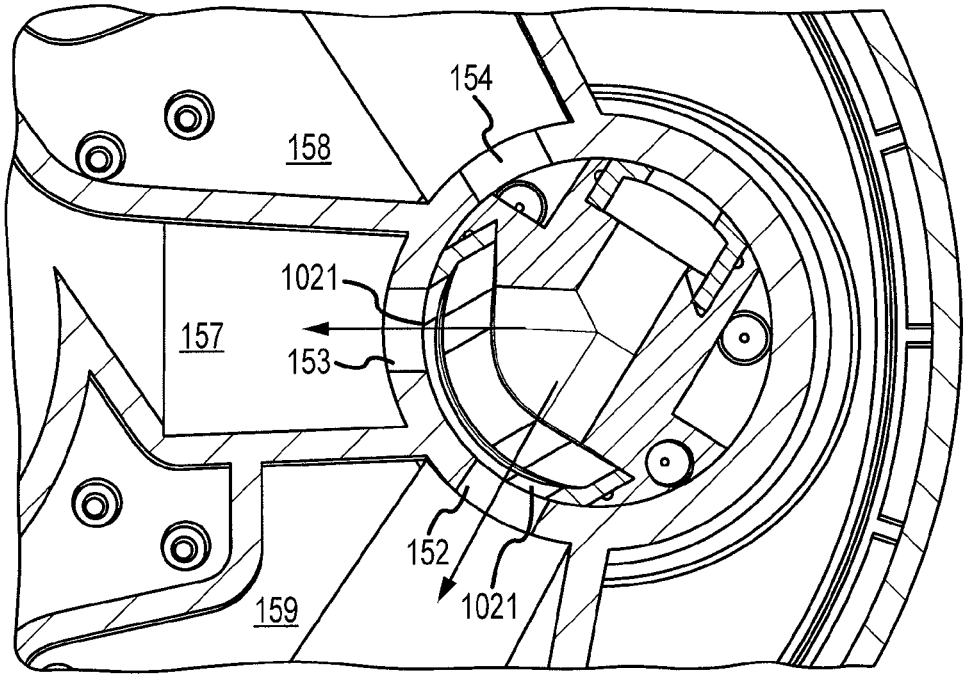

Referring to FIG. 6G, the radial mode changer 1001 has been rotated for partial alignment of exit aperture 1021 with mode apertures 152 and 153, respectively, corresponding to the outer spray chamber 159 and pulse spray chamber 157. Thus, flow from the first hollow passageway 1010 is split via mode apertures 153 and 152 as the flow from exit aperture 1021 is directed to both the pulse spray chamber 157 and the outer spray chamber 159, respectively. Accordingly, in use, spray emerges from the nozzles formed in the pulse spray and outer spray chambers 157, 159.

Figure 6H:
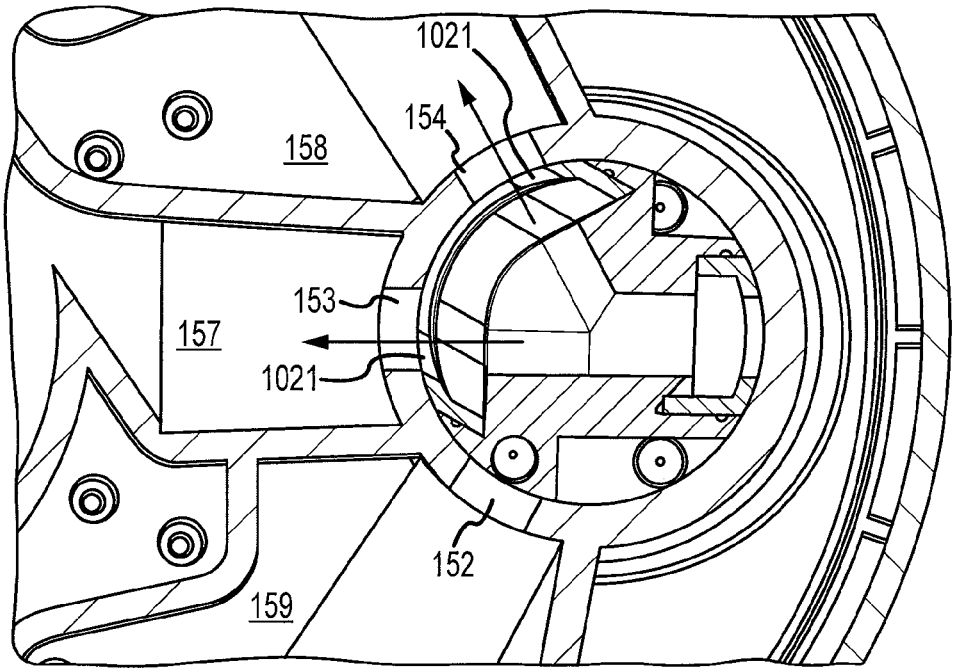

Referring to FIG. 6H, the radial mode changer 1001 is rotated to partially align exit aperture 1021 with mode apertures 154, 153, corresponding to the pulse spray chamber 157 and hard spray chamber 158, respectively. Thus, flow from the first hollow passageway 1010 emerging from exit aperture 1021 is split via mode apertures 153 and 154 and is directed to both the pulse spray chamber 157 and hard spray chamber 158, respectively, and spray emerges from the nozzles corresponding to the pulse spray and outer spray chambers 157, 158.

Figure 7:
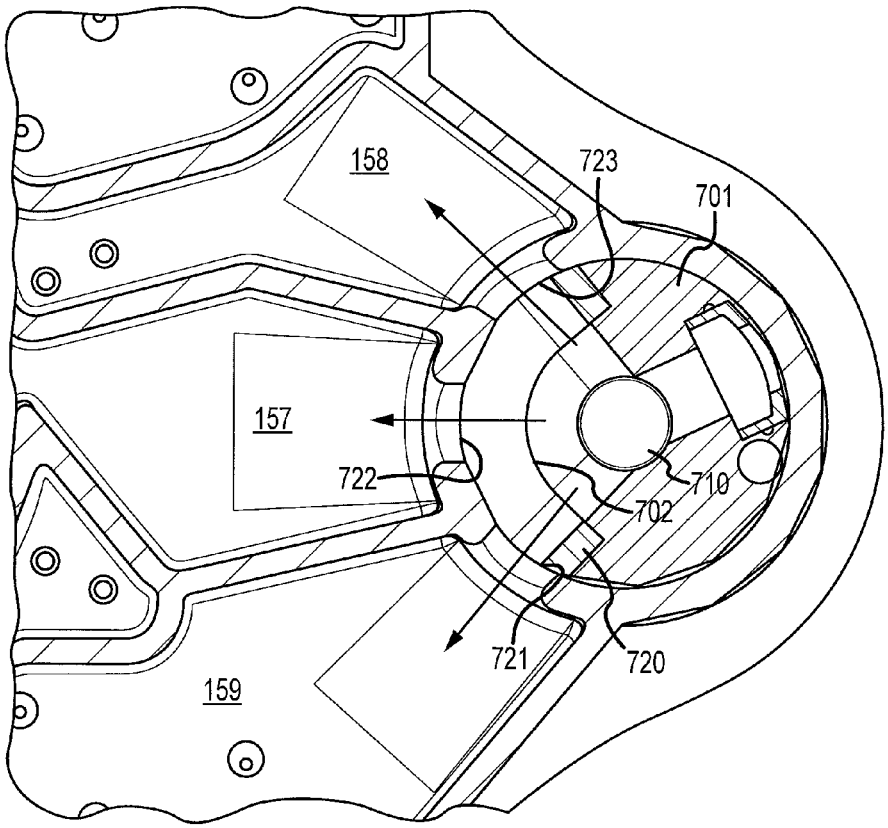
FIG. 7 is a cross-section view of a radial mode changer arranged in a section of the front channel plate according to an alternative embodiment.

FIG. 7 provides a view of an alternative radial mode changer 701 that may be incorporated into the shower assembly 100 according to the present disclosure. As illustrated, radial mode changer 701 is configured similarly to those of previous embodiments. In contrast, however, a recessed port 702 extends circumferentially around radial mode changer 701 a greater distance relative to previous embodiments, and has a seal cup 720 accommodated therein. Seal cup 720 may be provided with one or multiple exit apertures for providing flow to each of the mode apertures of the manifold. In the embodiment of FIG. 7, the radial mode changer 701 may be configured such that in at least one orientation of the mode changer 701, flow is provided to each of the pulse spray chamber 157, hard spray chamber 158, and outer spray chamber 159. For example, in one orientation, each of the exit apertures 721, 722, 723 may be at least partially aligned with mode apertures 152, 153, 154, corresponding to the hard spray chamber 157, pulse spray chamber 158, and outer spray chamber 159, respectively. Thus, flow from the first hollow passageway 710 may be directed to each the pulse spray chamber 157, hard spray chamber 158, and outer spray chamber 159 and spray may emerge from the nozzles formed in the chambers 157, 158 and 159. Upon rotation of the radial mode chamber 701, two modes may be selected, e.g., outer spray and pulse modes may be engaged when radial mode changer 701 is rotated counterclockwise, or hard and pulse modes may be engaged when radial mode changer 701 is rotated clockwise. Alternatively, one mode may be selected upon rotation of radial mode chamber 701 further in a clockwise or counterclockwise direction to align with a single mode aperture so that either hard or outer spray modes may be singly provided.

Figure 8A:
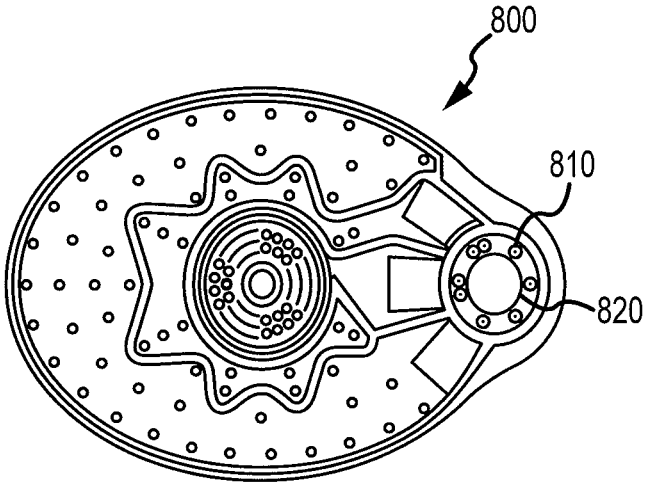
FIG. 8A is a top plan view of a front channel plate according to certain embodiments.
Figure 8B:
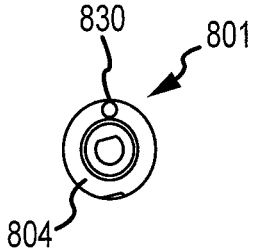
FIG. 8B is a bottom plan view of a radial mode changer according to certain embodiments.

In some embodiments, rotation of mode changer knob 126 to effect a change in spray mode is accompanied by tactile indication to a user that a desired spray mode has been achieved. Referring to FIGS. 8A and 8B, the front channel plate 800 (see FIG. 8A) may be provided with a plurality of indentations or holes 810 on annular rim 820, while radial mode changer 801 (see FIG. 8B) is configured with a passage defined by a protruding annular lip 830 arranged in a bottom surface of the body portion 804. When radial mode changer 801 is seated on annular rim 820 in the assembled shower assembly, as the mode changer knob (see FIG. 1) coupled to radial mode changer 801 is turned, the annular lip 830 drops into a hole 810 providing the user with a tactile indication that the radial mode changer 801 has changed position. In some embodiments, the indicator arrangement of holes 810 in annular rim 820 and annular lip 830 of radial mode changer 801 may provide tactile indications that correspond to the exit apertures of the radial mode changer 801 being aligned with one or more mode apertures. Thus, when one of the holes 810 receives annular lip 830, a predetermined spray mode, such as for example one of the spray modes described in FIGS. 6A-6G, may be established, as indicated by a tactile pause or bump in rotational motion during mode selection.

In use, the various configurations of the radial mode changer, along with the mode changer knob provide advantages that allow a user to select the desired spray mode without having to grasp around the entire perimeter of the shower assembly, which may possibly accidentally adjust the angle or direction the shower assembly is pointing. Additionally, while using a shower assembly configured according to certain embodiments, a user's hand may be less likely to interfere with the spray while adjusting the spray mode via the mode changer knob arranged behind the outflow nozzles, thus avoiding undesired splashing. In addition, because the perimeter of the shower assembly from which water exits need not be rotated to select the spray mode, the configuration of the area from which water outflow is provided is not limited to rotatable designs.

While embodiments are described in the context of a hand-held shower assembly, it will be appreciated that the embodiments may be incorporated into a variety of shower assemblies. For example, a radial mode changer and its associated components may be incorporated into a wall-mount shower head. The wall mount shower head may function similarly to the hand-held shower assembly, except that a wall-protruding water pipe may be coupled to a threaded water inflow assembly.

Shower assemblies, and the components thereof, may be fabricated using any suitable manufacturing methods including, without limitation, molding, injection molding, reaction injection molding, machining, pressing and punching. Additionally, components forming shower assemblies may be constructed of materials such as for example, metal, plastic, rubber, or combinations and variations thereof.

From the above description and drawings, it will be understood by those of ordinary skill in the art that the particular embodiments shown and described are for purposes of illustration only and are not intended to limit the scope of the present disclosure. Those of ordinary skill in the art will recognize that the present disclosure may be embodied in other specific forms without departing from its spirit or essential characteristics. References to details of particular embodiments are not intended to limit the scope of the disclosure.

What is claimed is:

1. A showerhead having a plurality of spray modes comprising a manifold defining a plurality of mode apertures;

a front channel plate comprising a plurality of front plate partitions connected to an exterior surface of the manifold and defining at least two channels, each channel of the at least two channels corresponding to one of the plurality of spray modes, wherein the mode apertures provide fluid communication between the manifold and the at least two channels;

a rear channel plate connected to the front channel plate, wherein the rear channel plate encloses the at least two channels to form at least two chambers; and a radial mode changer received in the manifold, the radial mode changer defining a hollow passageway in fluid communication with a water inflow and defining one or more ports in fluid communication with the hollow passageway, at least one port of the one or more ports extends around a portion of a circumference of the radial mode changer; wherein when the radial mode changer is rotated relative to the manifold to a first position, one or more of the ports is aligned with one or more of the mode apertures and water from the water inflow flows through the radial mode changer into one of the chambers providing water outflow to one of the plurality of spray modes; and when the radial mode changer is in a second position, the at least one port aligns with two mode apertures and a water flow is split by the two mode apertures receiving the water flow.

2. The showerhead of claim 1, wherein when the radial mode changer is rotated relative to the manifold to the second position, water from the water inflow flows through the radial mode changer into two of the chambers to provide water outflow to two of the plurality of spray modes.

3. The showerhead of claim 1, wherein the one or more ports comprises a first port and a second port, wherein when the first and second ports are aligned with a first mode aperture and a second mode aperture, respectively, the water outflow exiting the radial mode changer is split into two steams providing water flow into two of the at least two chambers.

4. The showerhead of claim 1 further comprising a respective sealing member received in a recess surrounding each of the one or more ports, wherein each sealing member defines a sealed conduit between the radial mode changer and one or more of the mode apertures.

5. The showerhead of claim 4, wherein the mode apertures are each defined by an opening formed in the manifold.

6. The showerhead of claim 5, wherein a rib extends across the opening formed in the manifold defining two apertures, wherein each mode aperture is defined by the two apertures.

7. The showerhead of claim 1, wherein the rear channel plate further comprises a plurality of rear plate partitions; and a top surface of the front plate partitions and a top surface of the rear plate partitions engage to form the at least two chambers.

8. The showerhead of claim 7, wherein the manifold is defined by a circular wall extending from a top surface of the front channel plate.

9. The showerhead of claim 8, wherein the radial mode changer comprises a first end and a second end, wherein the first end extends above the manifold and the second end extends below the manifold.

10. The showerhead of claim 9, further comprising a knob, wherein the knob engages the second end of the radial mode changer and movement of the knob rotates the radial mode changer relative to the manifold.

11. A showerhead having a plurality of spray modes comprising a first plate having a top surface and a bottom surface and comprising a plurality of first channel walls extending from the top surface;

a second plate connected to the first plate, the second plate having a top surface and a bottom surface and comprising a plurality of second channel walls extending from the bottom surface;

a manifold formed as an annular wall extending from the top surface of the first plate and having two or more mode apertures defined therein; and a radial mode changer positioned in the manifold and in fluid communication with a water inlet, the radial mode changer comprising one or more ports in selective fluid communication with the two or more mode apertures; wherein the first channel walls of the first plate engage the second channel walls of the second plate to define a plurality of chambers;

each of the plurality of chambers is in fluid communication with one of the two or more mode apertures defined in the manifold; and rotation of the radial mode changer within the manifold selectively varies water flow through the plurality of chambers.

12. The showerhead of claim 11, wherein the first plate further comprises a plurality of nozzles extending from the bottom surface, wherein each of the plurality of chambers is fluidly connected with a subset of the plurality of nozzles.

13. The showerhead of claim 12, wherein the radial mode changer has a first end and a second end, wherein the first end extends above a top end of annular wall and the second end extends below a bottom end of the annular wall.

14. The showerhead of claim 13, wherein a knob is connected to the second end of the radial mode changer and rotation of the knob rotates the radial mode changer within the manifold.

15. The showerhead of claim 11, wherein the radial mode changer further comprises a radial mode body defining a first hollow passageway through a center of the radial mode body and the first hollow passageway is in fluid communication with the water inlet and the one or more ports.

16. The showerhead of claim 15, wherein the radial mode changer body further defines a second hollow passageway through the center thereof and the second hollow passageway is not in fluid communication with the first hollow passageway.

17. The showerhead of claim 16, wherein an end of the radial mode body defining the second hollow passageway extends through the first plate and connects to a knob.

18. The showerhead of claim 11, wherein rotation of the radial mode changer to a first position fluidly connects a first chamber of the plurality of chambers with one of the one or more ports.

19. The showerhead of claim 18, wherein rotation of the radial mode changer to a second position fluidly connects the first chamber and a second chamber of the plurality of chambers with the one of the one or more ports.

20. The showerhead of claim 18, wherein rotation of the radial mode changer to a second position fluidly connects a second chamber of the plurality of chambers with one of the one or more ports and fluidly disconnects the first chamber with another one of the one or more ports.

* * * * *